US008699895B2

(12) United States Patent
Yamada

(10) Patent No.: US 8,699,895 B2
(45) Date of Patent: Apr. 15, 2014

(54) IMAGE FORMING APPARATUS, CONTROL METHOD AND COMPUTER-READABLE MEDIUM

(75) Inventor: Naoto Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/296,351

(22) Filed: Nov. 15, 2011

(65) Prior Publication Data

US 2012/0148270 A1 Jun. 14, 2012

(30) Foreign Application Priority Data

Dec. 8, 2010 (JP) ..... 2010-273943

(51) Int. Cl.
*G03G 15/08* (2006.01)

(52) U.S. Cl.
USPC ..... 399/27

(58) Field of Classification Search
USPC ..... 399/27
See application file for complete search history.

(56) References Cited

U.S. PATENT DOCUMENTS

2005/0047805 A1* 3/2005 Okubo ..... 399/27

FOREIGN PATENT DOCUMENTS

JP 5-323791 A 12/1993

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An image forming apparatus including a developing device corresponding to a color component, comprises: a conversion unit configured to accumulate, for each color component, values of respective pixels for each color component that fall within a predetermined range of image data, and to convert the accumulated value into a count value of the color component; an addition unit configured to add, to the image data, the count value of each color component that has been converted by the conversion unit; and a control unit configured, when forming an image based on the image data, to supply toner to the developing device of each color component in accordance with the count value of the color component that has been added by the addition unit.

11 Claims, 23 Drawing Sheets

FIG. 5

| 501 | VIDEO COUNT VALUE 502 | 503 | 504 | 505 |
|---|---|---|---|---|
| ACCUMULATED VALUE | Y | M | C | K |
| 34425001~ | 256 | 256 | 256 | 256 |
| 34290001~34425000 | 255 | 255 | 255 | 256 |
| 34155000~34290000 | 254 | 254 | 254 | 256 |
| ⋮ | ⋮ | ⋮ | ⋮ | ⋮ |
| 270001~405000 | 1 | 3 | 3 | 5 |
| 135001~270000 | 1 | 2 | 2 | 5 |
| 0~135000 | 1 | 1 | 1 | 1 |

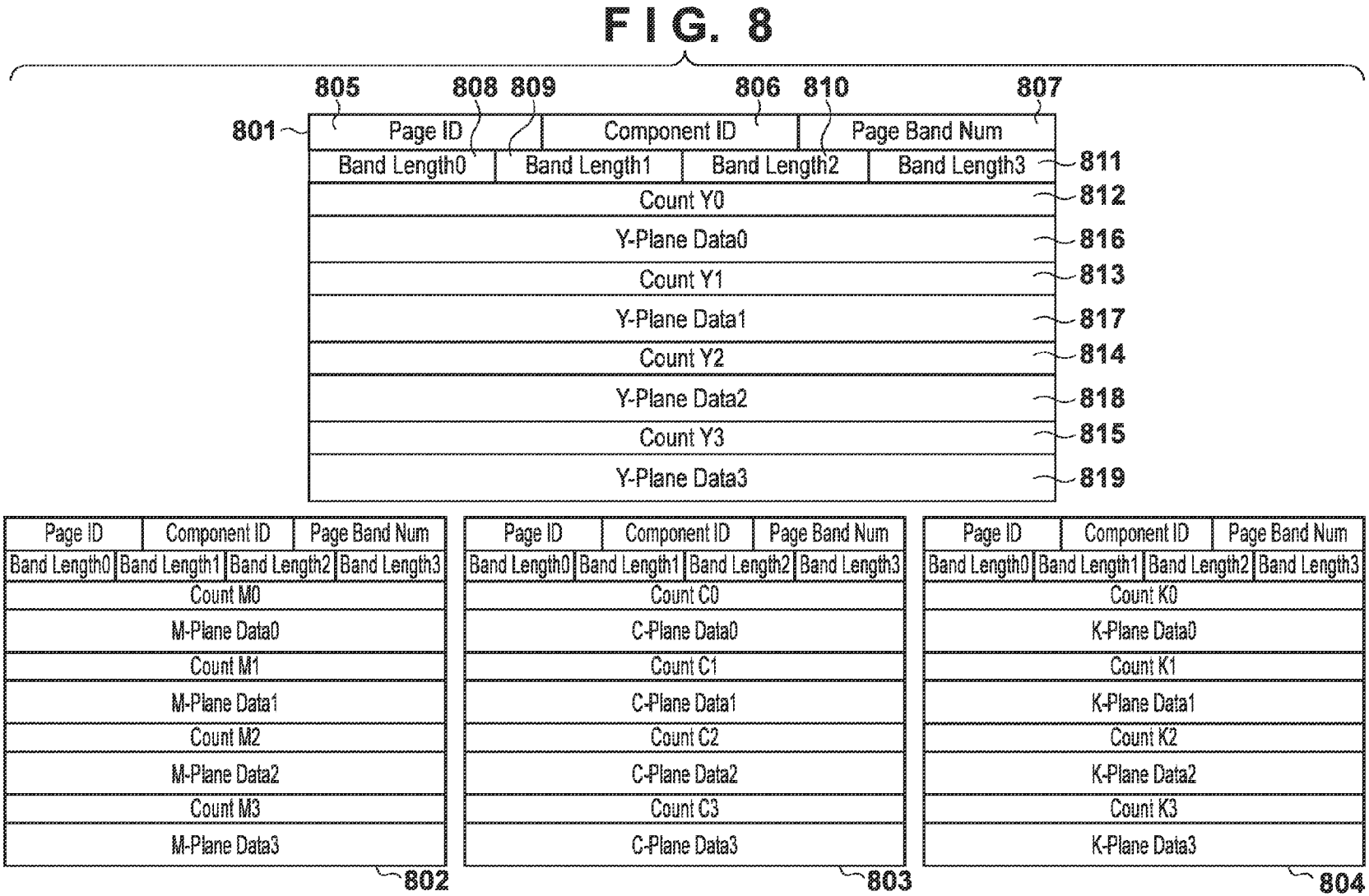
FIG. 8
801
805
808
809
806
810
807
811
812
816
813
817
814
818
815
819
Page ID
Component ID
Page Band Num
Band Length0
Band Length1
Band Length2
Band Length3
Count Y0
Y-Plane Data0
Count Y1
Y-Plane Data1
Count Y2
Y-Plane Data2
Count Y3
Y-Plane Data3
802
Page ID
Component ID
Page Band Num
Band Length0
Band Length1
Band Length2
Band Length3
Count M0
M-Plane Data0
Count M1
M-Plane Data1
Count M2
M-Plane Data2
Count M3
M-Plane Data3
803
Page ID
Component ID
Page Band Num
Band Length0
Band Length1
Band Length2
Band Length3
Count C0
C-Plane Data0
Count C1
C-Plane Data1
Count C2
C-Plane Data2
Count C3
C-Plane Data3
804
Page ID
Component ID
Page Band Num
Band Length0
Band Length1
Band Length2
Band Length3
Count K0
K-Plane Data0
Count K1
K-Plane Data1
Count K2
K-Plane Data2
Count K3
K-Plane Data3

IMAGE FORMING APPARATUS, CONTROL METHOD AND COMPUTER-READABLE MEDIUM

BACKGROUND OF THE INVENTION

1. Field of the Invention

The present invention relates to an image forming apparatus and control method for performing toner supply control using a video count, and a computer-readable medium.

2. Description of the Related Art

A developing device in an image forming apparatus of an electrophotographic type or electrostatic printing type generally adopts a two-component developer mainly containing toner particles and carrier particles. Especially, most developing devices in color image forming apparatuses for forming a full-color or multi-color image by an electrophotographic method use a two-component developer in terms of image tint and the like. The toner density (that is, the ratio of the weight of the toner particles to the total weight of the carrier particles and toner particles) of the two-component developer is a very important factor to stabilize the image quality. The toner particles of the developer are consumed in development and the toner density changes. Thus, the toner density needs to be always controlled constant to maintain the image quality by accurately detecting the toner density of the developer using a developer density control device (ATR: Auto Toner Replenisher), as needed, and supplying toner in accordance with the change.

To correct a change of the toner density in the developing device upon development, various types of toner density detection devices and density control devices in developer containers are in practical use to control the amount of toner to be supplied in development.

An example of these methods is an optical detection method using the fact that when a developer conveyed on a developer carrier or one in a developer container is irradiated with light from the vicinity of the developer carrier or the developer conveyance path of the developer container, the reflectance changes depending on the toner density. Note that the developer carrier is generally a developing sleeve and will be referred to as a "developing sleeve". There is also proposed an inductance detection method of detecting an actual toner density in a developing unit based on a detection signal from an inductance head which detects an apparent magnetic permeability based on the mixing ratio of a magnetic carrier and non-magnetic toner on side wall of the developer container and converts it into an electrical signal. Toner is supplied in accordance with a comparison between a detected density and a reference value using a developer density control device which detects and controls the toner density by these methods.

Another method is as follows. A patch image formed on an image carrier is irradiated with light emitted by a light source arranged at a position facing the surface of the patch image. A sensor receives the reflected light and reads the density of the patch image. An analog-to-digital converter converts the read value into a digital signal, and sends the digital signal to a CPU. If the read value indicates a density higher than an initial set value, toner supply stops until the density returns to the initial set value. If the density is lower than the initial set value, toner is forcibly supplied until the density returns to the initial set value. As a result, the toner density is indirectly maintained at a desired value. Note that the image carrier is generally a photosensitive drum and will be referred to as a "photosensitive drum".

However, the method of detecting a toner density from a reflectance obtained when a developer conveyed on the developing sleeve or one in the developer container is irradiated with light has a problem that no toner density can be detected accurately if the detector is contaminated with scattered toner or the like.

The inductance detection ATR has a problem that a sensor detection signal corresponding to an apparent magnetic permeability changes discontinuously as the bulk density of the developer changes when the developer is left to stand or the environment varies immediately before the operation of the image forming apparatus stops or immediately after the operation restarts.

The method of controlling a toner density indirectly from a patch image density has a problem that neither a space large enough to form a patch image nor a space large enough to install a detector can be ensured as a copying machine or image forming apparatus becomes compact.

As a method free from these problems, a toner supply method using a video count has come into practical use (see, for example, Japanese Patent Laid-Open No. 5-323791). In this method, to keep constant the toner density in the developing unit that decreases upon development, the output levels of the digital image signals of respective pixels are accumulated to obtain the printing ratio of an output image. A toner amount to be consumed is calculated from the obtained printing ratio, and toner is supplied in development. More specifically, a video count corresponding to the tone values or dot counts of respective pixels in multi-level video data in image processing, binary video data after halftone processing, or the like is converted into a toner supply amount. The converted toner supply amount is sent to a CPU. The CPU transmits a toner supply signal for a predetermined time based on the toner supply amount. In response to this, a toner supply device is driven to supply a necessary amount of toner to a developer container. Hence, the toner density is kept constant in the developer container.

However, in Japanese Patent Laid-Open No. 5-323791, the value of a toner supply amount that is generated based on a video count value accumulated from video data during image processing is temporarily transmitted to the CPU, and output as a toner supply signal from the CPU, driving the toner supply device. In this case, software processing by the CPU intervenes, so a development timing based on supply target video data does not match an actual toner supply operation timing.

For a tandem engine in which drums for forming an electrostatic latent image are arranged in tandem, multi-level image data undergoes halftone processing and is rasterized into respective binary color component data. Then, the color component data are sequentially transmitted to corresponding drums at timings to form an electrostatic latent image. These timings actually have a time difference based on the distance between the drum stations of respective color components and the printing speed. Actual color toners are sequentially consumed with this time difference. For example, a case in which drum stations are arranged in order of Y, M, C, and K (Yellow, Magenta, Cyan, and Black) will be considered. In this case, when an electrostatic latent image of the first page is formed on the K drum at the final stage, an electrostatic latent image of the second page to be printed next is formed on the Y drum. In control of simultaneously performing Y, M, C, and K toner supply operations, a time difference is always generated in formation of electrostatic latent images. That is, the tandem engine has a problem that a time difference in development exists between a drum arranged upstream and one arranged downstream, and if toner supply timings are adjusted to any drum, a supply target page and toner supply timing do not match each other.

SUMMARY OF THE INVENTION

The present invention provides an image forming apparatus capable of supplying toner at an appropriate timing by adding the count value of respective pixels for each color component directly to video data of the color component and transmitting it to a printer engine to eliminate the time difference between toner supply timings.

According to one aspect of the present invention, there is provided an image forming apparatus including a developing device corresponding to a color component, comprising: a conversion unit configured to accumulate, for each color component, values of respective pixels for each color component that fall within a predetermined range of image data, and to convert the accumulated value into a count value of the color component; an addition unit configured to add, to the image data, the count value of each color component that has been converted by the conversion unit; and a control unit configured, when forming an image based on the image data, to supply toner to the developing device of each color component in accordance with the count value of the color component that has been added by the addition unit.

According to another aspect of the present invention, there is provided a method of controlling an image forming apparatus including a developing device corresponding to a color component, comprising: a conversion step of accumulating, for each color component, values of respective pixels for each color component that fall within a predetermined range of image data, and converting the accumulated value into a count value of the color component; an addition step of adding, to the image data, the count value of each color component that has been converted in the conversion step; and a control step of, when forming an image based on the image data, supplying toner to the developing device of each color component in accordance with the count value of the color component that has been added in the addition step.

According to another aspect of the present invention, there is provided a non-transitory computer-readable medium storing a program for causing a computer to function as a conversion unit configured to accumulate, for each color component, values of respective pixels for each color component that fall within a predetermined range of image data, and to convert the accumulated value into a count value of the color component, an addition unit configured to add, to the image data, the count value of each color component that has been converted by the conversion unit, and a control unit configured, when forming an image based on the image data, to supply toner to the developing device of each color component in accordance with the count value of the color component that has been added by the addition unit.

Actually generated video data and the time difference between toner supply timings based on the video data can be eliminated by reading and transmitting the count value of each video count via a CPU in correspondence with each color component.

Toner can be supplied at an appropriate timing, improving the stability of image quality and density without causing a mismatch between a correction page and target toner supply control owing to the time difference between drum stations.

Further features of the present invention will become apparent from the following description of exemplary embodiments (with reference to the attached drawings).

BRIEF DESCRIPTION OF THE DRAWINGS

FIG. 5 is a view showing the structure of a count conversion LUT;

FIG. 8 is a view for explaining a data format according to the second embodiment;

DESCRIPTION OF THE EMBODIMENTS

First Embodiment

[System Configuration]

Figure 1:
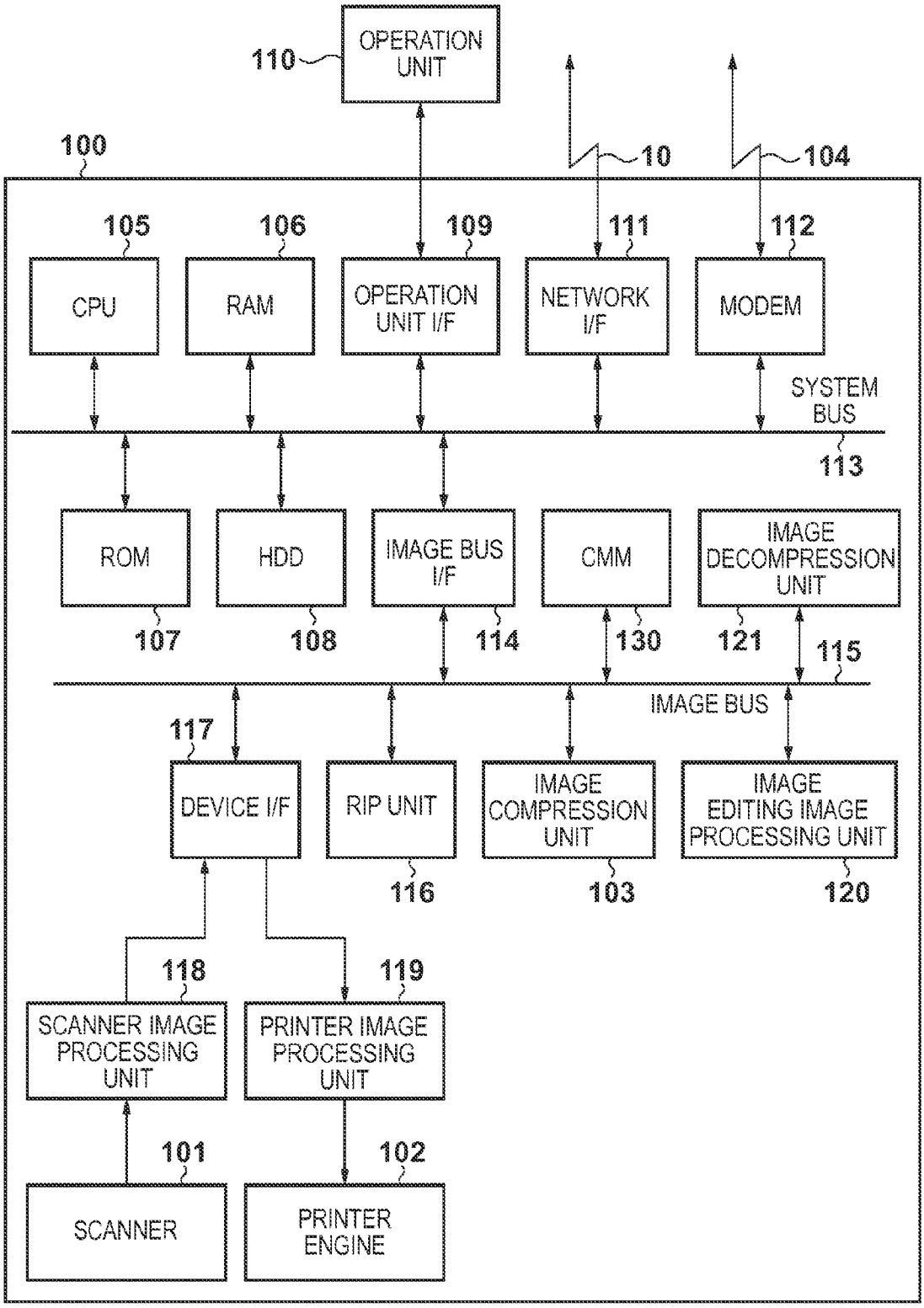
FIG. 1 is a block diagram showing the whole configuration of an image processing system.

An embodiment of the present invention will now be described with reference to the accompanying drawings. FIG. 1 is a block diagram showing the whole configuration of an image processing system according to the first embodiment. Referring to FIG. 1, a scanner 101 serving as an image input device and a printer engine 102 serving as an image output device are internally connected in an image forming apparatus 100. The scanner 101 is connected to a device I/F 117 via a scanner image processing unit 118. The printer engine 102 is connected to the device I/F 117 via a printer image processing unit 119. The scanner image processing unit 118 and printer image processing unit 119 perform control to read image data and print out. The image forming apparatus 100 is connected to a LAN 10 and public line 104, and performs control to input/output image information and device information via the LAN 10.

A CPU (Central Processing Unit) 105 controls the image forming apparatus 100. A RAM 106 is a system work memory used by the CPU 105 to operate, and is also an image memory for temporarily storing input image data. A ROM 107 is a boot ROM which stores the boot program of the system. An HDD (Hard Disk Drive) 108 stores system software programs for various processes, input image data, and the like.

An operation unit I/F 109 is an interface with an operation unit 110 having a display screen capable of displaying image data and the like. The operation unit I/F 109 outputs operation screen data to the operation unit 110. The operation unit I/F 109 transmits, to the CPU 105, information input by the operator via the operation unit 110. A network I/F 111 is implemented by a LAN card or the like, and is connected to the LAN 10 to input/output information to/from an external apparatus (not shown). A modem 112 is connected to the public line 104 to input/output information to/from an external apparatus (not shown). These units are arranged on a system bus 113.

An image bus I/F 114 is an interface for connecting the system bus 113 and an image bus 115 for transferring image data at high speed, and is a bus bridge for converting a data structure. A raster image processor (RIP) unit 116, the device I/F 117, the scanner image processing unit 118, an image editing image processing unit 120, an image compression unit 103, an image decompression unit 121, and a color management module (CMM) 130 are connected to the image bus 115.

The RIP unit 116 rasterizes a PDL (Page Description Language) code into image data. The device I/F 117 connects the scanner 101 and printer engine 102 via the scanner image processing unit 118 and printer image processing unit 119, and performs synchronous/asynchronous image data conversion.

The scanner image processing unit 118 executes various processes such as correction, processing, and editing for image data input from the scanner 101. The image editing image processing unit 120 performs various image processes such as rotation of image data, scaling, color processing, trimming & masking, binary conversion, multi-level conversion, and blank paper determination. The image compression unit 103 encodes image data processed by the RIP unit 116, scanner image processing unit 118, and image editing image processing unit 120 when temporarily storing the image data in the HDD 108.

When compressed image data in the HDD 108 is to be processed by the image editing image processing unit 120 or printer image processing unit 119 and output to the printer engine 102, as needed, the image decompression unit 121 decodes and decompresses the compressed/encoded data. The printer image processing unit 119 executes image processing correction corresponding to the printer engine for image data to be printed out, video data count processing for toner control according to the present invention, and the like.

The CMM 130 is a dedicated hardware module for performing color conversion processing (also called color space conversion processing) based on a profile or calibration data for image data. The profile is information like a function for converting color image data expressed in a device-dependent color space into one in a device-independent color space (for example, Lab color space). The calibration data is used to correct the color reproduction characteristics of the scanner 101 and printer engine 102.

[Software Configuration]

Figure 2:
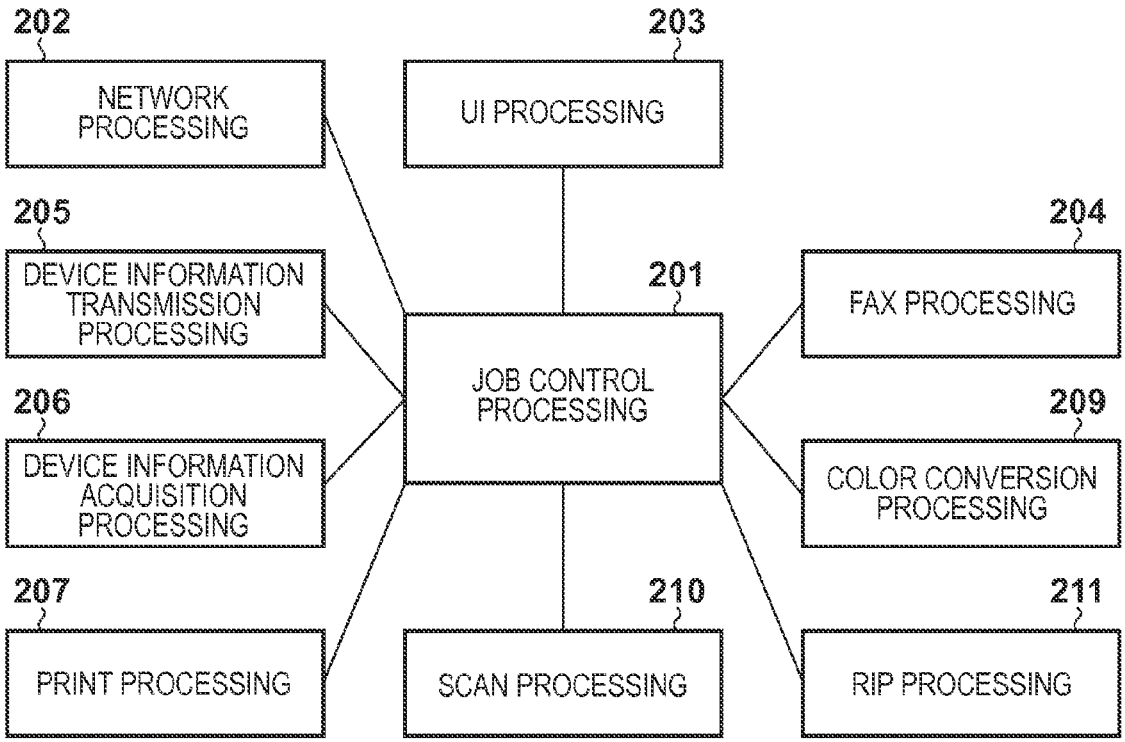
FIG. 2 is a block diagram showing software modules.

Software modules shown in FIG. 2 are stored in the HDD 108 serving as a storage unit and run mainly on the CPU 105. Job control processing 201 shown in FIG. 2 integrates and controls respective software modules (shown/not shown), and controls all jobs generated in the image forming apparatus 100, including copying, printing, scanning, and FAX transmission/reception.

Network processing 202 is a module for mainly controlling communication with the outside via the network I/F 111, and controls communication with each device on the LAN 10. Upon receiving a control command or data from each device on the LAN 10, the network processing 202 notifies the job control processing 201 of the contents. The network processing 202 transmits a control command or data to each device on the LAN 10 based on an instruction from the job control processing 201.

UI processing 203 performs control mainly regarding the operation unit 110 and operation unit I/F 109. The UI processing 203 notifies the job control processing 201 of the contents of an instruction input by the operator via the operation unit 110. In addition, the UI processing 203 controls the display contents of the display screen on the operation unit 110 based on an instruction from the job control processing 201.

FAX processing 204 controls the FAX function. The FAX processing 204 performs FAX reception via the modem 112, executes image processing specific to a FAX image, and notifies the job control processing 201 of the received image. Also, the FAX processing 204 FAX-transmits an image designated by the job control processing 201 to a designated notification destination.

Print processing 207 controls the image editing image processing unit 120, printer image processing unit 119, and printer engine 102 based on an instruction from the job control processing 201, and performs print processing for a designated image. The print processing 207 accepts, from the job control processing 201, information such as image data, image information (for example, image data size, color mode, and resolution), layout information (for example, offset, enlargement/reduction, and imposition), and output paper information (for example, size and printing direction). The print processing 207 controls the image compression unit 103, image decompression unit 121, image editing image processing unit 120, and printer image processing unit 119, and executes proper image processing for image data. The print processing 207 controls the printer engine 102 to print image data on designated paper.

Based on an instruction from the job control processing 201, scan processing 210 controls the scanner 101 and scanner image processing unit 118 to scan a document on the scanner 101. The instruction from the job control processing 201 contains a color mode setting, and the scan processing 210 executes processing complying with the color mode. More specifically, the document is input as a color image when the color mode is "color", and as a monochrome image when the color mode is "monochrome". When the color mode is "Auto", the color/monochrome of a document is determined by pre-scanning or the like, and the document is scanned and input again as an image based on the determination result.

The scan processing 210 executes scanning of a document on the document table of the scanner 101, and inputs an image as digital data. The scan processing 210 notifies the job control processing 201 of color information of the input image. The scan processing 210 controls the scanner image processing unit 118 to perform appropriate image processing such as image compression for the input image. Then, the scan processing 210 notifies the job control processing 201 of the input image having undergone the image processing.

Color conversion processing 209 performs color conversion processing for a designated image based on an instruction from the job control processing 201, and notifies the job control processing 201 of the image having undergone the color conversion processing. The job control processing 201 notifies the color conversion processing 209 of input color space information, output color space information, and an image to undergo color conversion.

For example, when an output color space notified to the color conversion processing 209 is a color space (for example, Lab color space) independent of an input device, the color conversion processing 209 is notified of even an input profile as information for converting an input color space (for example, RGB color space) dependent on an input device into the Lab color space. Based on the input profile, the color conversion processing 209 creates a lookup table (LUT) for mapping from the input color space into the Lab color space, and executes color conversion for an input image using the LUT.

When an input color space notified to the color conversion processing 209 is the Lab color space, the color conversion processing 209 is notified of even an output profile for converting the Lab color space into an output color space dependent on an output device. Based on the output profile, the color conversion processing 209 creates an LUT for mapping from the Lab color space into the output color space, and executes color conversion for an input image using the LUT.

When both input and output color spaces notified to the color conversion processing 209 are device-dependent color spaces, the color conversion processing 209 is notified of both input and output profiles. By using the input and output profiles, the color conversion processing 209 creates an LUT for direct mapping from the input color space into the output color space, and performs color conversion for an input image using the LUT.

If the CMM 130 exists within the apparatus, the color conversion processing 209 sets the generated LUT in the CMM 130 and executes color conversion using the CMM 130. If the CMM 130 does not exist, the color conversion processing 209 performs color conversion processing as software by the CPU 105. Note that processes executed by the color conversion processing 209 are not limited to the above-described method and can be achieved by any method.

RIP processing 211 performs PDL interpretation based on an instruction from the job control processing 201. The RIP processing 211 controls the RIP unit 116 to execute rendering and rasterization into a bitmap image.

[Control by System]

With the above arrangement, the image processing system performs an operation up to printing upon receiving a print job via the LAN 10. Control by the system having the above arrangement will be explained in detail.

As described above, PDL data transmitted from an external apparatus via the LAN 10 is received by the network I/F 111, and input to the RIP unit 116 via the image bus I/F 114. The RIP unit 116 interprets the received PDL data, and converts it into code data processible by the RIP unit 116. The RIP unit 116 executes rendering based on the converted code data. Page data rendered by the RIP unit 116 are compressed by the image compression unit 103 at a succeeding stage, and sequentially stored in the HDD 108.

The compressed data stored in the HDD 108 is read out in a print operation based on an instruction from the job control processing 201, and decompressed by the image decompression unit 121. If necessary, the image data decompressed by the image decompression unit 121 is input to the image editing image processing unit 120, undergoes image editing processing, and is input to the printer image processing unit 119 via the device I/F 117.

Figure 3:
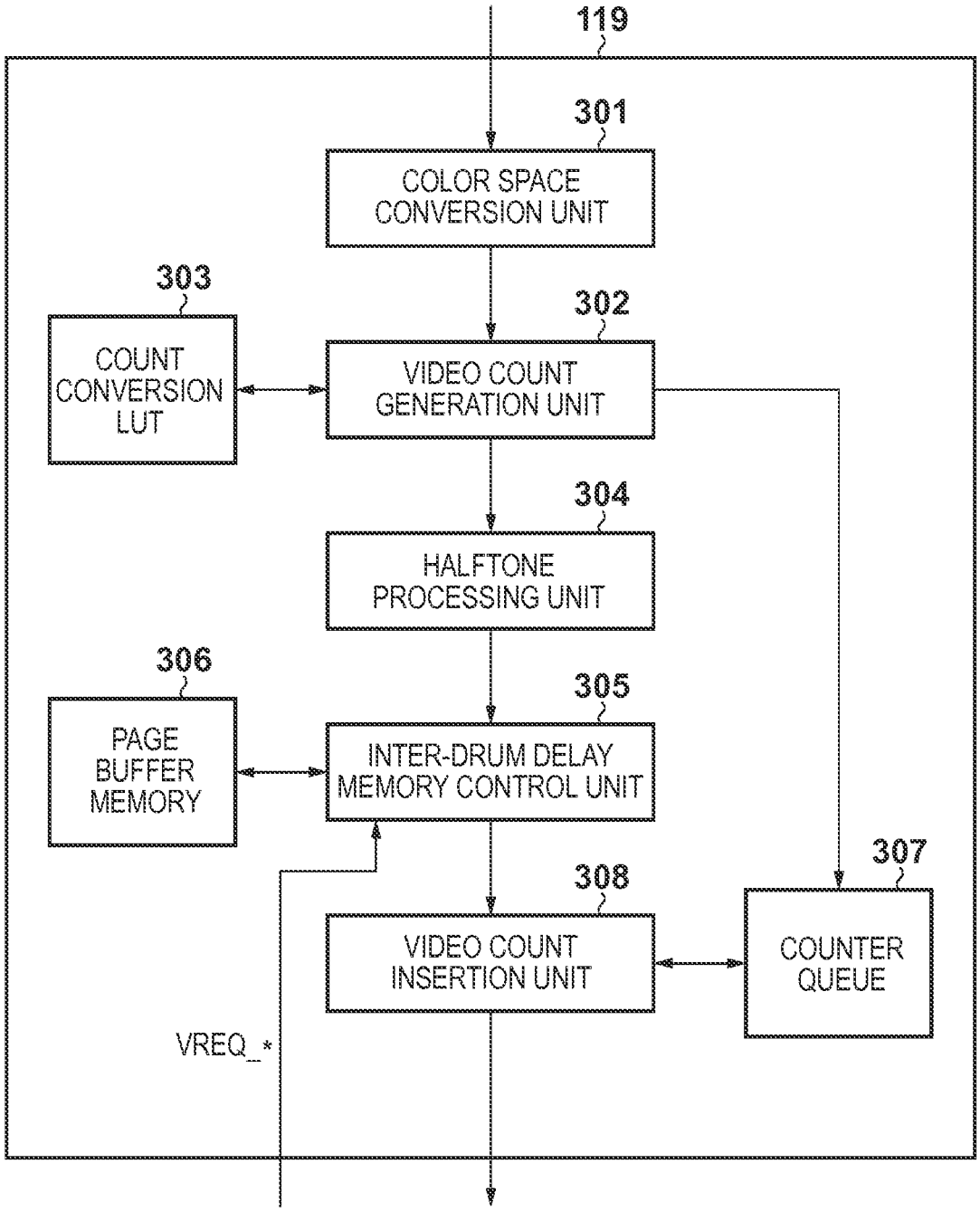
FIG. 3 is a block diagram showing the internal arrangement of a printer image processing unit according to the first and second embodiments.

FIG. 3 is a block diagram showing the internal arrangement of the printer image processing unit 119 in the embodiment. A color space conversion unit 301 converts image data from a luminance value (for example, RGB or YUV) into a density value (for example, CMYK). The color space conversion unit 301 converts the respective color components of input image data into a color space corresponding to color components printable by the printer engine 102 at a succeeding stage.

A video count generation unit 302 accumulates, in a predetermined unit of pixels for each color component, multi-level data in which each color component data of image data per pixel is expressed by a plurality of bits. The predetermined unit is, for example, a page unit or a predetermined area unit within a page in an image to be formed. A count conversion LUT 303 is used to convert values accumulated by the video count generation unit 302 in the predetermined unit for respective color components into values (to be referred to as video counts) indicating the driving times of toner supply control motors 1208 to 1211. "Video count" used by this application indicates value in which integrated value of multi-valued data of each color component of each pixel is converted by the video count generation unit 302 referring to the count conversion LUT 303. That is, the video counts are video count value columns 502 to 505 of FIG. 5, and the video count is "1" to "256". The LUT allows arbitrarily changing an internally held video count value by communication with the CPU 105 via a CPU command bus (not shown). The internally held video count will be described later.

A halftone processing unit 304 performs halftone processing to convert image data formed from multi-level pixels as described above into image data in which the color component of each pixel is expressed by a binary value (1 bit).

An inter-drum delay memory control unit 305 controls a page buffer memory 306. The page buffer memory 306 buffers data of the respective color components by delays between photosensitive drums 1401 to 1404 on which electrostatic latent images of the respective color components are formed in the printer engine 102, based on an instruction from the inter-drum delay memory control unit 305. Also, based on an instruction from the inter-drum delay memory control unit 305, the page buffer memory 306 reads out buffered data and inputs it to a video count insertion unit 308.

A counter queue 307 holds a video count for each color component that is generated by the video count generation unit 302 by converting, using the count conversion LUT 303, a value counted and accumulated by the video count generation unit 302 for each color component.

The video count insertion unit 308 adds a video count held in the counter queue 307 as the header of each page defined in a predetermined field to image data of each color component input from the inter-drum delay memory control unit 305. The field and header will be described later.

[Image Data Processing Sequence]

A processing sequence for image data input to the printer image processing unit 119 will be explained based on the above arrangement.

The color space conversion unit 301 converts image data input to the printer image processing unit 119 from a luminance value (RGB in this embodiment) into a density value (CMYK in this embodiment). The video count generation unit 302 accumulates multi-level data of respective pixels for each color component in the image data converted into CMYK data serving as a density value. When the value of Y data of the first pixel is "100" and that of Y data of the second pixel is "50" for each color component having an 8-bit (0 to 255) tone level, the accumulated value of the first and second pixels is "150". In the embodiment, values for each color component data in one page are counted and used as an accumulated value.

For example, for A4-size, 600-dpi image data, values for each color component are accumulated by 7,015 pixels in the main scanning direction×4,962 pixels in the sub-scanning direction=34,808,430 pixels per page. After executing accumulation for one page, the video count generation unit 302 compares the held accumulated value with a value set in advance in the count conversion LUT 303, and can convert the counted accumulated value into a video count.

FIG. 5 exemplifies a set value in the count conversion LUT 303. The leftmost column is an accumulated value column 501 in which the sum of accumulated values of one page is divided into predetermined ranges. Video count value columns 502 to 505 represent video count values of respective color components (Y: yellow, M: magenta, C: cyan, K: black) in correspondence with respective accumulated values. As shown in FIG. 5, a value corresponding to an accumulated value is defined for each color component.

For example, when the yellow accumulated value of an arbitrary page is "140000", a value "1" corresponding to a "135001 to 270000" row in the accumulated value column 501 is sent back as a video count to the video count generation unit 302. In this way, a video count corresponding to each color component of an arbitrary page is obtained by looking up the count conversion LUT 303. Then, conversion into a video count corresponding to each color component of one page ends. The counter queue 307 (to be described later) receives the generated video count of each color component of one page, and temporarily holds it.

The halftone processing unit 304 performs halftone processing for multi-level image data counted by the video count generation unit 302, converting each color component of one pixel into image data expressed by a binary value (1 bit). Halftone processing generally adopts a dither method or error diffusion method, and either method is usable in the embodiment. Note that halftone processing is not limited to the above method and may be executed using another method.

The binary image data generated by conversion processing in the halftone processing unit 304 is separated into the respective color components of each pixel in image data via the inter-drum delay memory control unit 305. The separated color components are temporarily stored in the page buffer memory 306.

Figure 6:
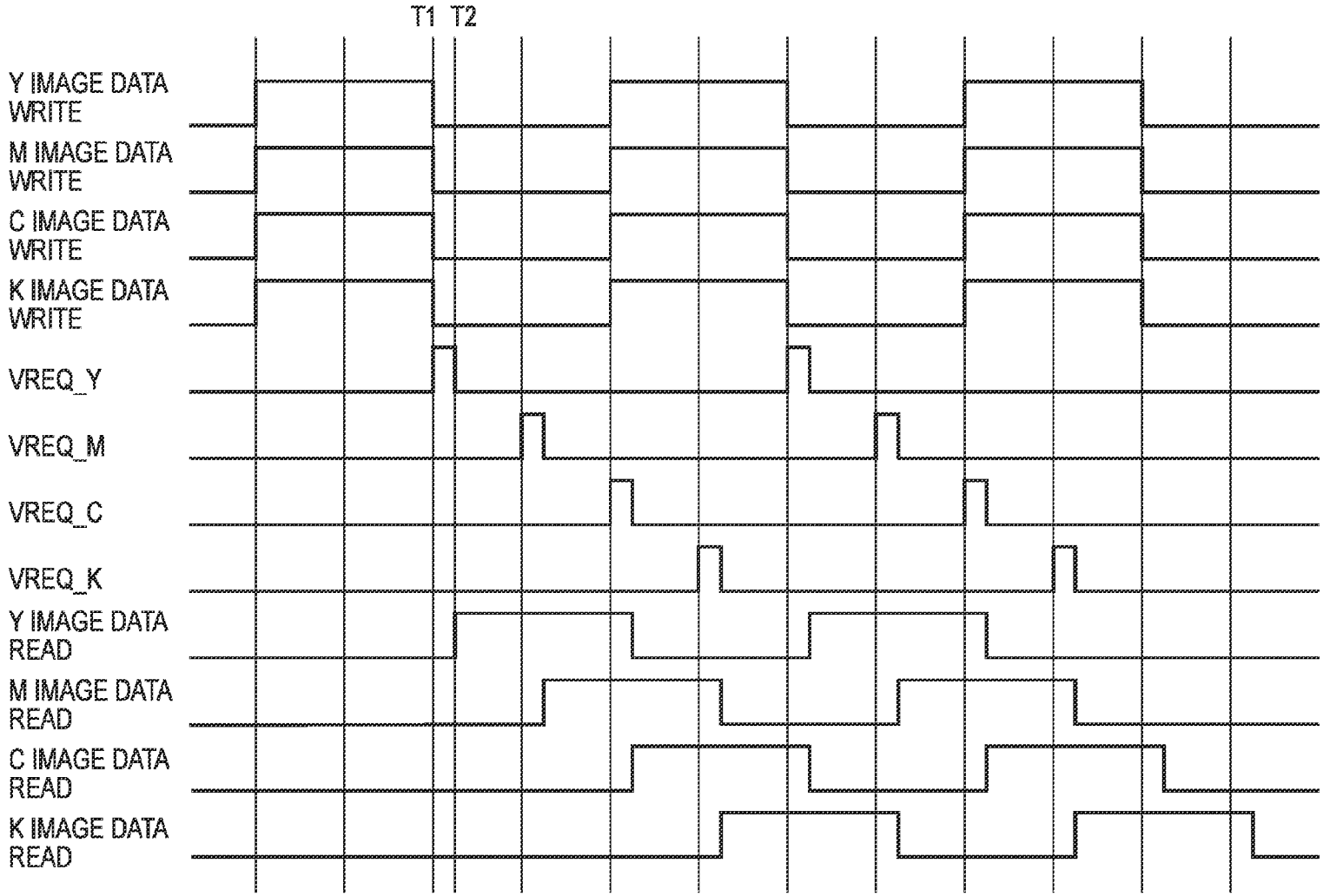
FIG. 6 is a timing chart showing the write and read operations of a page buffer memory.

FIG. 6 is a timing chart exemplifying the write and read operations of the page buffer memory 306. As shown in FIG. 6, in the write operation (described as "* image data WRITE": "*" indicates Y, M, C, and K) of the page buffer memory 306, the respective color components are simultaneously input and written. To the contrary, in the read operation, data of corresponding color components are read out at the timing when video data request signals transmitted from the printer engine 102 for the respective color components are input, as shown in the timing chart of FIG. 6. In FIG. 6, the read operation is described as "* image data READ" ("*" indicates Y, M, C, and K).

In FIG. 6, the video data request signals are VREQ_Y, VREQ_M, VREQ_C, and VREQ_K for the respective color components. Timings to read out data of the respective color components differ from each other because timings to expose the photosensitive drums 1401 to 1404 differ from each other in accordance with distances from the upstream side to the downstream side at which the photosensitive drums 1401 to 1404 corresponding to the respective color components are arranged in the printer engine 102. At timing T1 shown in FIG. 6, a memory capacity for the four colors of at least one buffered page and a memory capacity for the four colors of the next page need to be ensured. In the embodiment, therefore, the page buffer memory 306 has a memory capacity of two pages.

The embodiment assumes that the write clock to perform the write operation and the read clock to perform the read operation have the same frequency, that is, the write time and read time of one page for each color component are equal. However, when the write time and read time are different from each other, the capacity of the page buffer memory 306 needs to be ensured based on the frequency ratio and the above-mentioned arrangement distances of the photosensitive drums 1401 to 1404.

Video data of the respective color components that are held in the counter queue 307 are sequentially added as header data to the starts of respective color component data sequentially output from the page buffer memory 306 in response to VREQ_* ("*" indicates Y, M, C, and K).

[Data Format]

Figure 7:
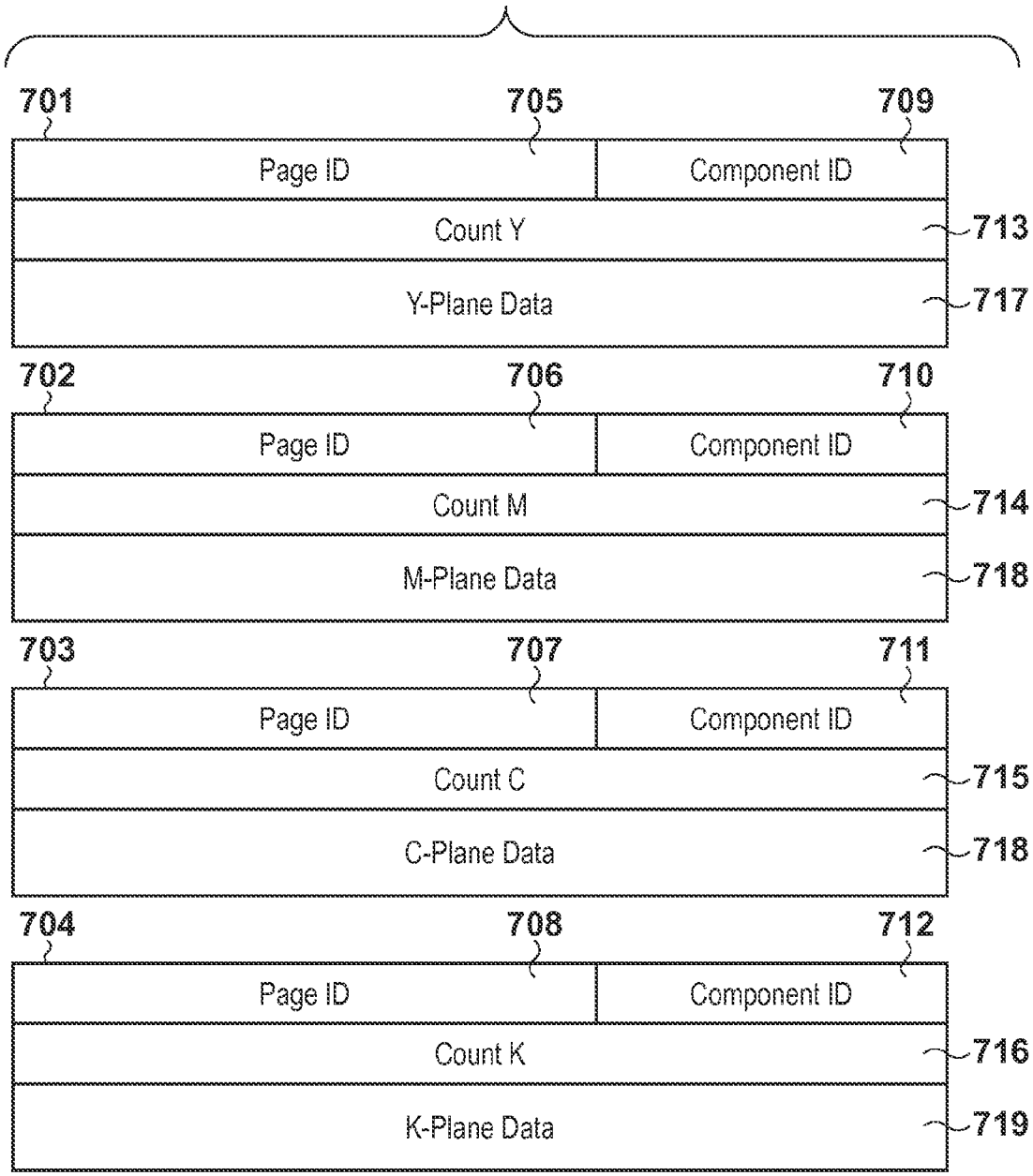
FIG. 7 is a view for explaining a data format according to the first embodiment.

FIG. 7 is a view showing the data format of actual color component data and added video count data. Page data Y 701, page data M 702, page data C 703, and page data K 704 shown in FIG. 7 exemplify yellow, magenta, cyan, and black page data, respectively. Page IDs 705 to 708 are the fields of IDs indicating the number of each page, and are added in the page order by the video count generation unit 302. Each of the fields of the Page IDs 705 to 708 is formed from, for example, 6 bits.

Component IDs 709 to 712 are the fields of IDs for identifying the color component of page data as Y, M, C, or K. In the embodiment, these fields suffice to be 2-bit fields to assign "00, "01", "10", and "11" to Y, M, C, and K, respectively.

Count * (* indicates Y, M, C, and K) 713 to 716 are fields for adding the video counts of the respective color components that are held in the counter queue 307. Each of the fields of the Count * 713 to 716 is formed from, for example, 8 bits (0 to 256). *-Plane Data (* indicates Y, M, C, and K) 717 to 720 are fields where actual image data of the respective color components are stored.

Note that the data format is not limited to the above-described bit counts, and may be changed in accordance with the maximum image data size to be handled, the number of pages, the number of colors, and the like.

[Operations in Counter Queue and Video Count Generation Unit]

Figure 10:
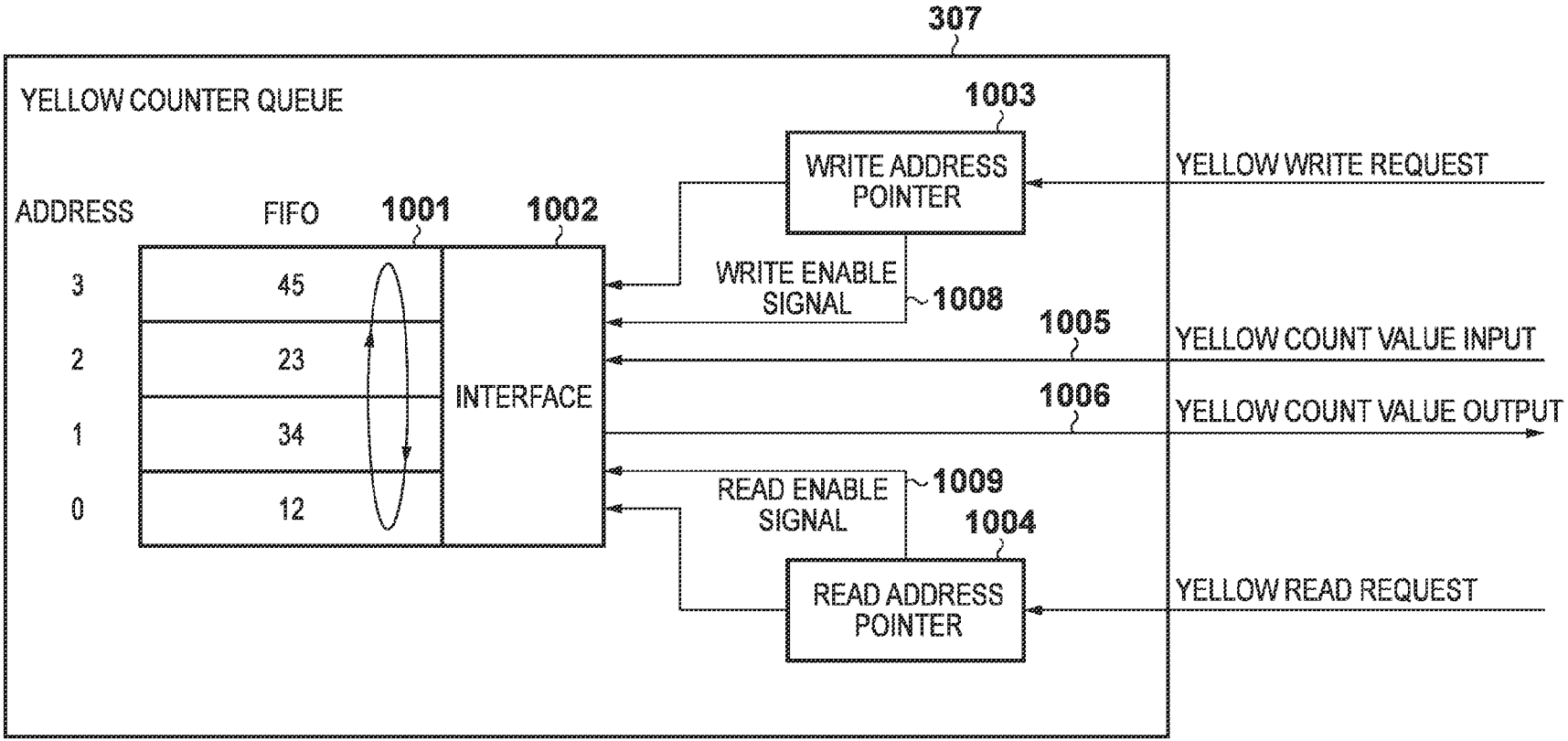
FIG. 10 is a view showing the internal arrangement of a counter queue according to the first embodiment.

The operations of the counter queue 307 and video count generation unit 302 will be explained. FIG. 10 is a view showing the internal arrangement of the counter queue 307. FIG. 10 shows the arrangement of a counter queue for yellow serving as one color component. The counter queue 307 incorporates counter queues for the remaining magenta, cyan, and black color components, and these counter queues have the same arrangement. As shown in FIG. 10, the counter queue includes the memory of a 4-word long FIFO (First-In First-Out) 1001 as a counter queue. The FIFO 1001 has addresses 0 to 3.

Figure 11:
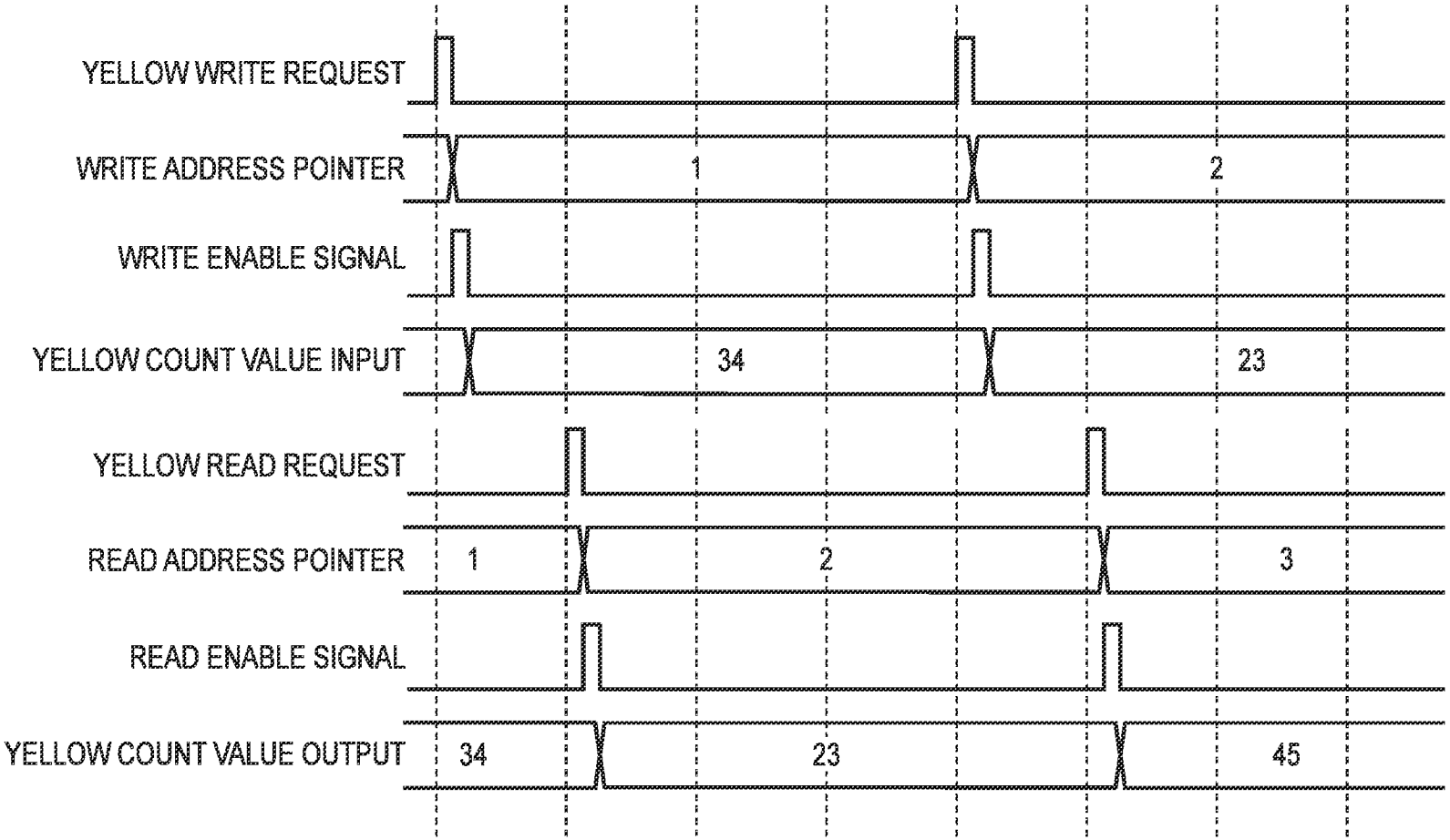
FIG. 11 is a timing chart showing the operation of the counter queue according to the first and second embodiments.

The operation of the yellow counter queue in the counter queue 307 will be described, but the operations of the remaining magenta, cyan, and black counter queues are also the same as that of the yellow counter queue. FIG. 11 is a timing chart for explaining the operation of the yellow timing chart in the counter queue 307. A video count generated for each color component by the video count generation unit 302 changes a yellow write request in FIG. 11 to "ON" at the generation timing (T1 shown in FIG. 6). Upon receiving the "ON" signal of the yellow write request, a write address pointer 1003 increments the internal address pointer by one.

Further, the write address pointer 1003 changes a write enable signal to "ON" to permit a write operation to the FIFO 1001, and outputs a write address value and a write enable signal 1008 to an interface 1002. At this timing, the video count generation unit 302 inputs the video count of a corresponding color component (yellow count value in this case) to the interface 1002 via a yellow count value input 1005. The interface 1002 stores the yellow count value input via the yellow count value input 1005 in a memory area of the FIFO 1001 that corresponds to the write enable signal 1008 and the write address input from the write address pointer 1003.

The video count insertion unit 308 changes, to "ON", a read request signal corresponding to each color for the counter queue 307 at the timing (T2 shown in FIG. 6) of sequential output from the inter-drum delay memory control unit 305 at a preceding stage. Upon receiving the "ON" read request signal, a read address pointer 1004 increments the internal address pointer by one. Further, the read address pointer 1004 changes a read enable signal to "ON" to permit a read operation to the FIFO 1001, and outputs a read address value and a read enable signal 1009 to the interface 1002. The interface 1002 outputs, via a yellow count value output 1006, the count value of each color component (yellow count value in this case) stored in a memory area of the FIFO 1001 that corresponds to the input read address.

In the embodiment, the FIFO 1001 has addresses of the 4-word length, and can hold video counts for a total of four pages. However, the present invention is not limited to this arrangement, and the word length of the FIFO 1001 needs to be determined in accordance with the write timing and read timing.

The video count insertion unit 308 adds count values corresponding to the respective color components to the predetermined fields of the Count * (* indicates Y, M, C, and K) 713 to 716. The video count insertion unit 308 adds even the Page IDs 705 to 708 and Component IDs 709 to 712. In this fashion, the video count insertion unit 308 forms the page headers of the page data * (* indicates Y, M, C, and K) 701 to 704 shown in FIG. 7.

The video count insertion unit 308 combines the generated page headers with the fields of the *-Plane Data (* indicates Y, M, C, and K) 717 to 719 which store the respective color component data. Then, the video count insertion unit 308 sequentially outputs the combined data as the page data * (* indicates Y, M, C, and K) 701 to 704 to the printer engine 102.

[Printer Engine Operation]

Figure 12:
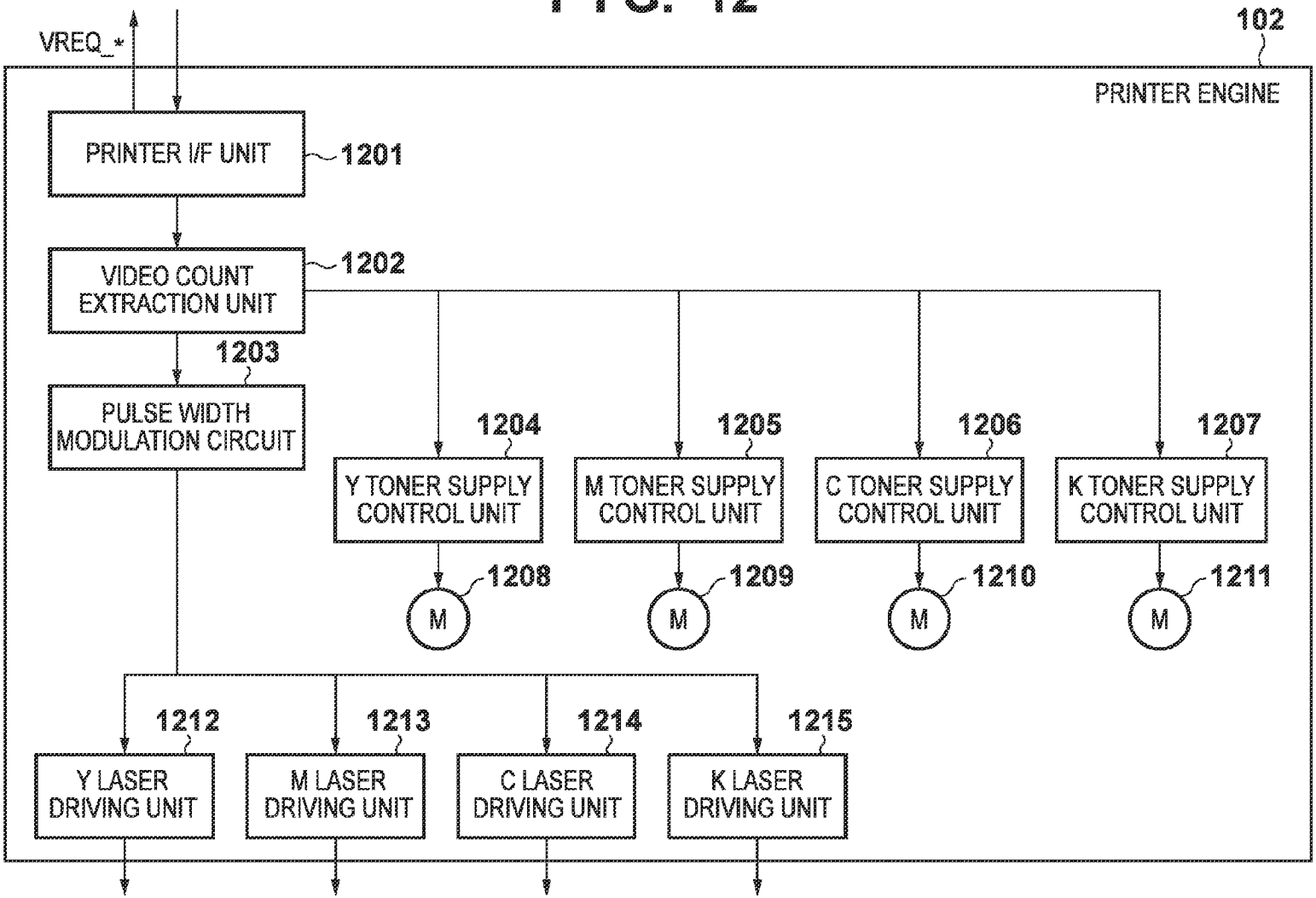
FIG. 12 is a block diagram showing part of the internal arrangement of a printer engine.

An operation when the printer engine 102 receives page header-added color component data output from the printer image processing unit 119 will be explained. FIG. 12 shows part of the internal arrangement of the printer engine 102. A printer I/F unit 1201 receives color component data sequentially transmitted from the printer image processing unit 119. The printer I/F unit 1201 issues video data request signals VREQ_* (* indicates Y, M, C, and K) which request data of the respective color components when the printer engine 102 is ready for a print operation.

A video count extraction unit 1202 extracts the Count * (* indicates Y, M, C, and K) 713 to 716 of the respective color components that have been added by the video count insertion unit 308, as described above. The video count extraction unit 1202 transmits the extracted values to * toner supply control units (* indicates Y, M, C, and K) 1204 to 1207 of corresponding color components.

The toner supply control units 1204 to 1207 drive the * toner supply motors (* indicates Y, M, C, and K) 1208 to 1211 for supplying toner in accordance with the received Count * values. For example, when the value of the Count Y 713 serving as a yellow video count is "100", the Y toner supply control unit 1204 outputs a driving signal to the Y toner supply motor 1208 to drive the toner supply motor only for 1 sec.

The color component data are input to a pulse width modulation circuit 1203 via the video count extraction unit 1202. Based on the *-Plane Data 717 to 720 serving as actual color component data, the pulse width modulation circuit 1203 generates pulse signals (driving signals) for driving * laser driving units 1212 to 1215 of the respective colors at a succeeding stage. The pulse width modulation circuit 1203 transmits the pulse signals to the laser driving units 1212 to 1215.

Based on the pulse signals received from the pulse width modulation circuit 1203, the laser driving units 1212 to 1215 corresponding to the respective color components drive laser exposure devices (to be described later) corresponding to the respective color components.

[Laser Driving Operation]

Figure 13:
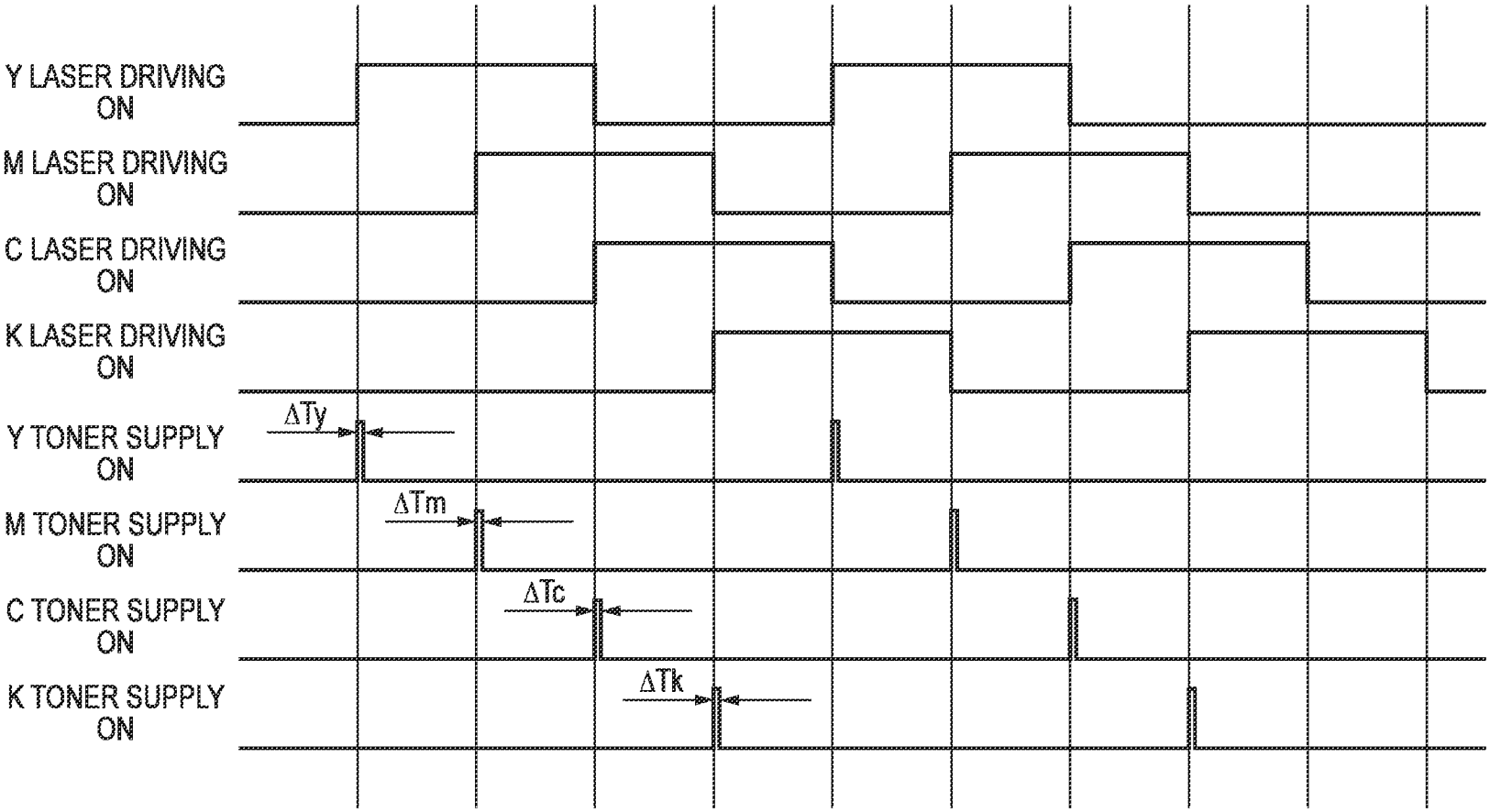
FIG. 13 is a timing chart showing laser driving and a toner supply operation according to the first embodiment.

FIG. 13 is a timing chart showing the laser driving timings of the laser driving units 1212 to 1215 based on the transmission timings of actual color component data, and the driving timings of the toner supply motors 1208 to 1211. As shown in FIG. 13, the printer engine 102 receives the *-Plane Data 717 to 720 serving as color component data of the respective colors, and the Count * 713 to 716 for supplying toner. Thus, the laser driving timings of the respective colors and corresponding toner supply operations can always be synchronized with each other. In FIG. 13, ΔTy, ΔTm, ΔTc, and ΔTk differ between the color components because they are times necessary for "ON" signals based on the Count * 713 to 716 added as the headers of the corresponding *-Plane Data 717 to 720.

[Printer Engine Structure]

Figure 14:
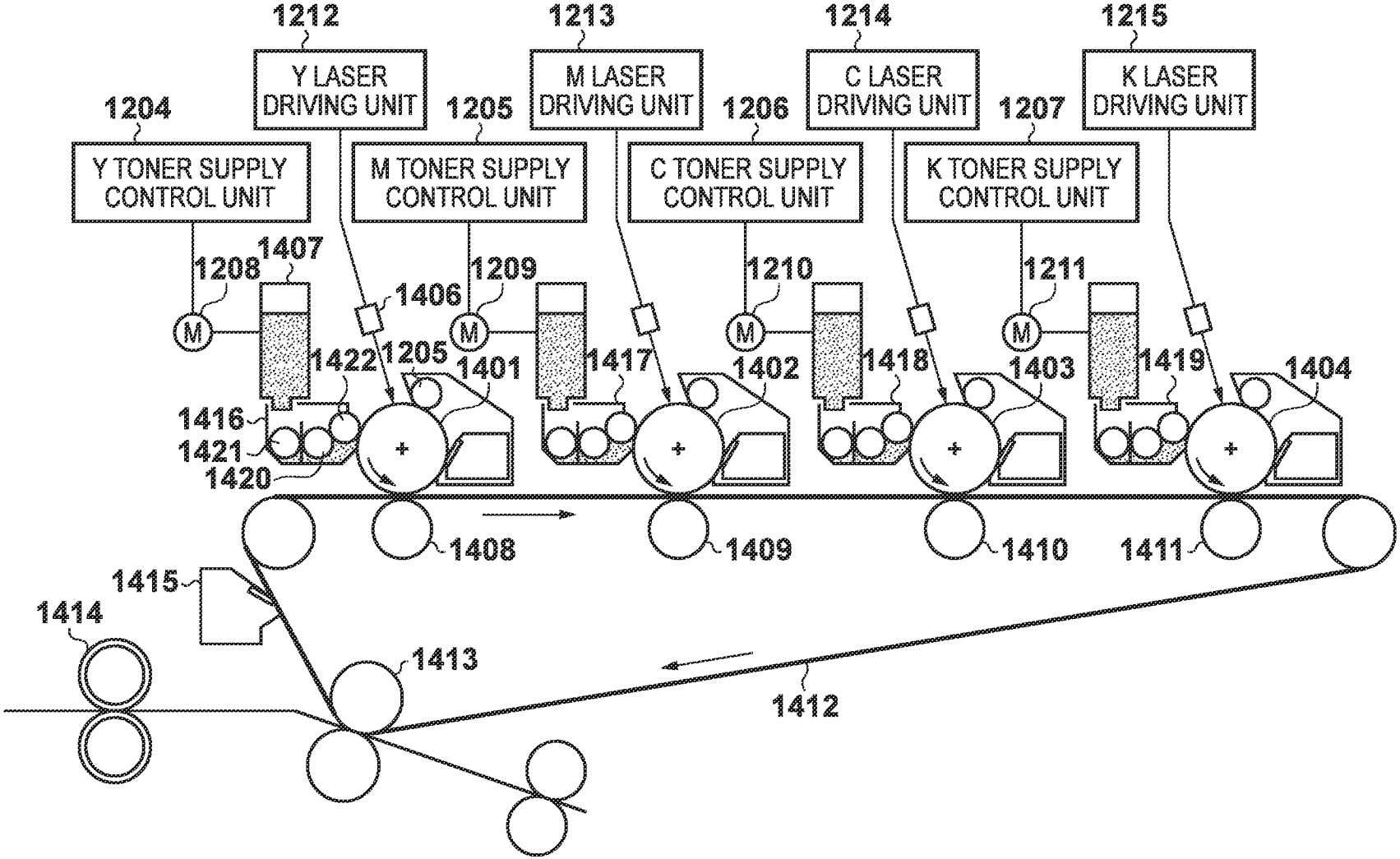
FIG. 14 is a sectional view showing the image forming portion of the printer engine.

FIG. 14 is a sectional view showing the image forming portion of the printer engine 102. Although a yellow image forming portion will be mainly explained, the image forming portions of the remaining magenta, cyan, and black color components have the same arrangement. In the embodiment, the printer engine 102 is for an image forming apparatus using a tandem engine for four, Y, M, C, and K. However, the present invention is applicable to a tandem engine image forming apparatus using two or more colors. For example, a tandem engine for three, C, M, and Y, or a tandem engine for six colors additionally including two, light magenta and light cyan is available.

The printer engine 102 includes the photosensitive drum 1401 serving as an image carrier, a charging roller 1405, a Y laser exposure device 1406, a Y tonner supply mechanism 1407, a primary transfer device 1408, a secondary transfer device 1413, a fixing device 1414, and a cleaning device 1415. The Y laser driving unit 1212 drives the Y laser exposure device 1406. The Y tonner supply mechanism 1407 controls the supply operation based on the Y toner supply motor 1208 driven by the Y toner supply control unit 1204. The primary transfer device 1408 primarily transfers a visualized toner image onto a transfer medium 1412. The secondary transfer device 1413 secondarily transfers, onto a printing sheet, the toner image formed on the transfer medium 1412. The fixing device 1414 fixes the toner image transferred on the printing sheet. The cleaning device 1415 removes transfer left on the transfer medium 1412 after secondary transfer.

A developing device 1416 includes a developer container, and stores a developer prepared by mixing toner particles (toner) and magnetic carrier particles (carrier) as a two-component developer. An A screw 1420 and B screw 1421 perform conveyance of the toner particles and mixing with the magnetic carrier particles, respectively. Note that the tonner supply mechanism 1407 is arranged above the B screw 1421, and drops and supplies toner by an amount corresponding to a toner consumption amount calculated based on the video count of each color. A developing sleeve 1422 is arranged near the photosensitive drum 1401, rotates following the photosensitive drum 1401, and stores a developer prepared by mixing toner and carrier. The developer in the developing sleeve 1422 contacts the photosensitive drum 1401, developing an electrostatic latent image on the photosensitive drum 1401. Note that the printer engine 102 includes a conveyance unit (not shown) which conveys a printing sheet, in addition to the arrangement in FIG. 14, but a description thereof will be omitted in the embodiment.

In this printer engine arrangement, when printing in yellow, the Y laser exposure device 1406 driven by the Y laser driving unit 1212 exposes the photosensitive drum 1401, forming an electrostatic latent image on the photosensitive drum 1401. The formed electrostatic latent image is visualized as a toner image with a yellow developer stored in the developing sleeve 1422 within the developing device 1416. The primary transfer device 1408 transfers the visualized toner image onto the transfer medium 1412.

In the same manner, electrostatic latent images of the magenta, cyan, and black color components are developed by developing devices 1417, 1418, and 1419, and visualized as toner images on the photosensitive drums 1402, 1403, and 1404. The visualized toner images are sequentially transferred by primary transfer devices 1409, 1410, and 1411 in synchronism with immediately preceding transferred toner images of color components. A final toner image is formed from the toner images of the four colors on the transfer medium 1412.

The secondary transfer device 1413 secondarily transfers, onto a synchronously conveyed printing medium, the toner image formed on the transfer medium 1412. The fixing device 1414 fixes the toner image. Then, the printer engine 102 discharges the printing sheet and ends the print operation.

[Toner Supply Operation]

Figure 15A:
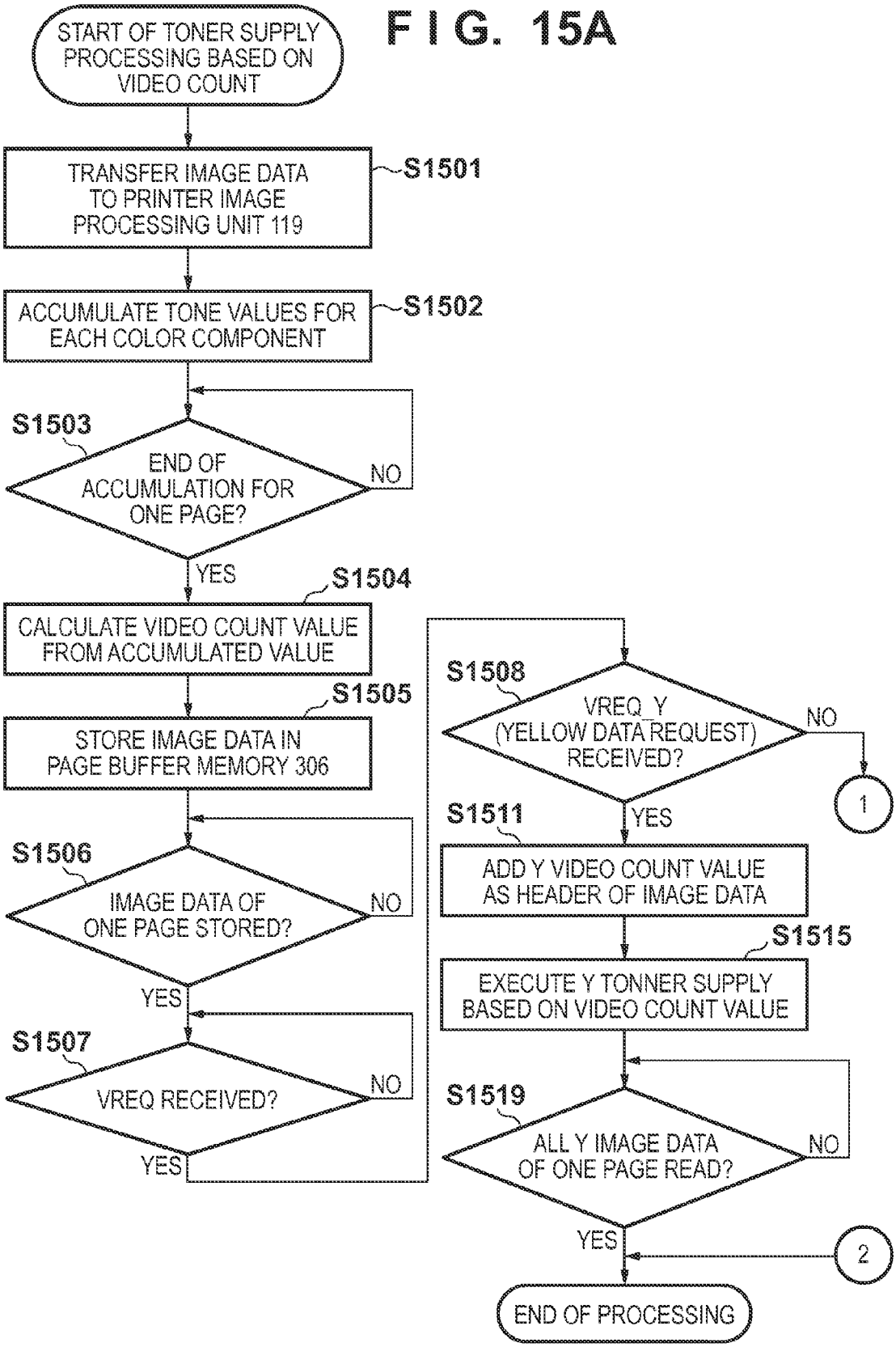
FIGS. 15A and 15B are flowcharts showing a toner supply operation according to the first embodiment.
Figure 15B:
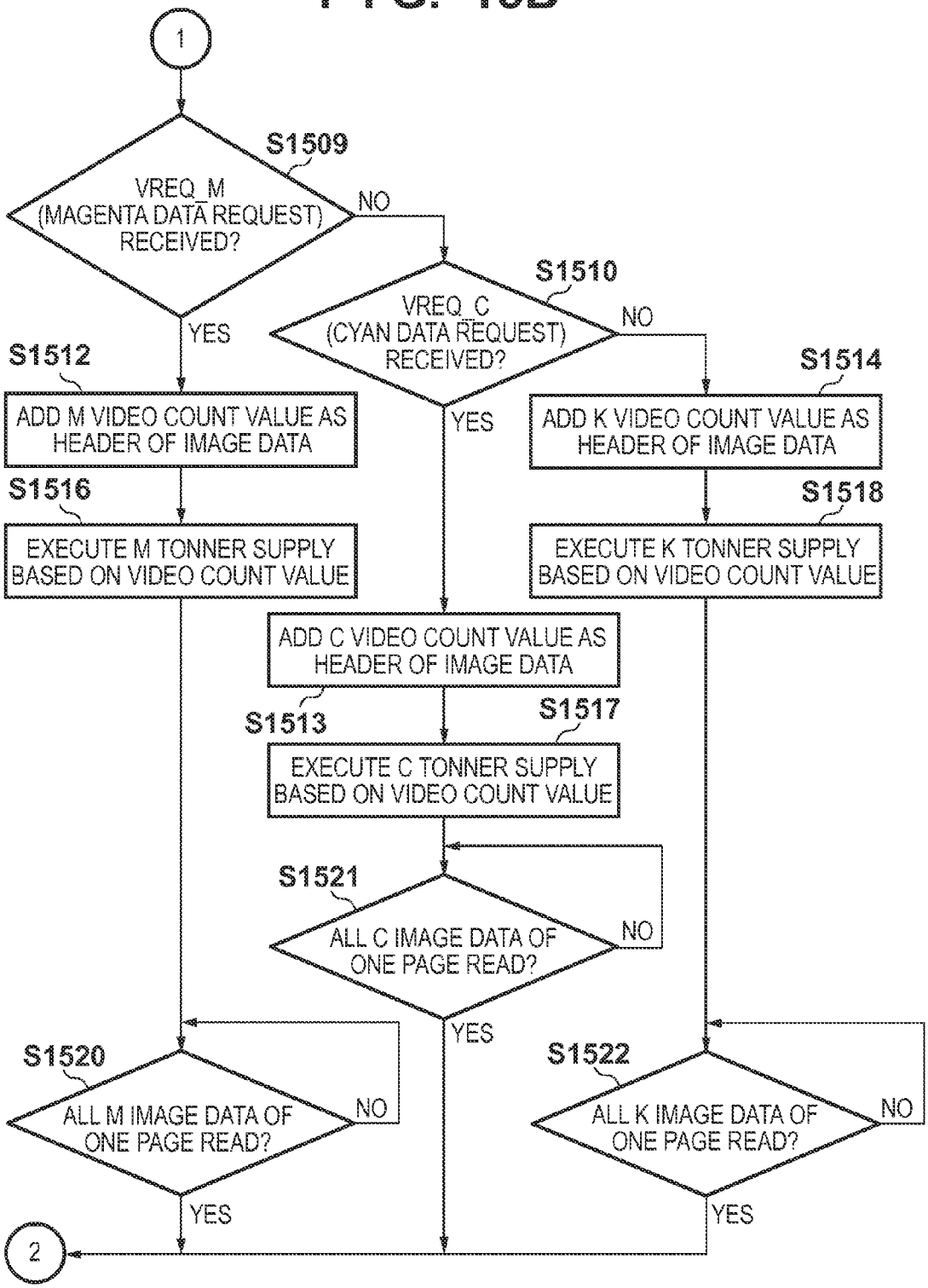

Generation of a video count, addition of image data, and a toner supply operation based on the video count according to the embodiment will be described with reference to the flowcharts of FIGS. 15A and 15B. Note that this processing sequence is implemented by reading out a program stored in the HDD 108 serving as a storage unit or the like, and executing it by the CPU 105 of the image forming apparatus 100.

Image data rendered and rasterized by the RIP unit 116 are compressed by the image compression unit 103 and sequentially stored in the HDD 108. The image data stored in the HDD 108 are decompressed by the image decompression unit 121. The image data decompressed by the image decompression unit 121 are transferred to the printer image processing unit 119 via the device I/F 117 (step S1501). After the color space conversion unit 301 converts the color space of the image data transferred to the printer image processing unit 119, the video count generation unit 302 accumulates the tone values (multi-values) of respective pixels for the respective color component data (Y, M, C, and K in this case) (step S1502).

After the end of accumulating tone values for one page (YES in step S1503), the video count generation unit 302 calculates toner supply-related video counts from the accumulated values by looking up the count conversion LUT 303 as shown in FIG. 5 (step S1504). The image data are sequentially stored in the page buffer memory 306 (step S1505). After storing image data of one page (YES in step S1506), the inter-drum delay memory control unit 305 waits until it receives VREQ (video data request signal) from the printer engine 102 (step S1507). After receiving VREQ (YES in step S1507), the inter-drum delay memory control unit 305 determines VREQ_* (* is one of Y, M, C, and K) of a corresponding color component (step S1508, S1509, or S1510). If the inter-drum delay memory control unit 305 has received VREQ_* of a corresponding color component, the video count insertion unit 308 sequentially reads out corresponding color component data from the page buffer memory 306. The video count insertion unit 308 adds each video count held in the counter queue 307 as header data of the corresponding color component data (step S1511, S1512, S1513, or S1514).

The video count extraction unit 1202 in the printer engine 102 extracts the video count of each color component from the received data, and executes toner supply of each color in synchronism with a laser exposure timing corresponding to the color component data (step S1515, S1516, S1517, or S1518). After reading out color component data of one page from the page buffer memory 306 (YES in step S1519, S1520, S1521, or S1522), laser exposure by the * laser driving unit 1212, 1213, 1214, or 1215 and development are done. The processing sequence then ends.

As described above, the values of pixels of image data for the respective color component data are accumulated and converted into video counts associated with toner consumption amounts. The video counts are added as header data of data to be actually printed by the printer engine. An amount of toner to be actually used can be supplied in synchronism with the actual development timing of a printer engine corresponding to each color component, unlike a case in which a video count is transmitted via the CPU to supply toner.

According to the first embodiment, the amount of toner of each color can be supplied in correspondence with the development timing difference between the respective color components even in a tandem engine having a plurality of photosensitive drums for the respective color components.

Second Embodiment

In the first embodiment, the video count is accumulated in the page unit. The second embodiment will describe a method of dividing image data of one page into a plurality of units and adding a video count for each color component in the divided unit, and toner supply control based on this method. An image forming apparatus 100 and each software module have the same arrangements as those in the first embodiment, a processing sequence up to input to a printer image processing unit 119 in a printer operation is also the same, and a description thereof will not be repeated.

In the printer operation, similar to the first embodiment, a color space conversion unit 301 converts image data input to the printer image processing unit 119 from a luminance value (RGB in this embodiment) into a density value (CMYK in this embodiment) in the above-described manner. A video count generation unit 302 accumulates the tone values (multi-level data) of respective pixels for each color component in the image data converted into CMYK data. In the second embodiment, tone values in an area obtained by dividing one page into four areas are counted and used as an accumulated value.

For example, for A4-size, 600-dpi image data, a size of 7,015 pixels in the main scanning direction×4,962 pixels in the sub-scanning direction is divided into four in the sub-scanning direction. At this time, an accumulated value is calculated at a size of 7,015 pixels in the main scanning direction×1,241 pixels in the sub-scanning direction (the size of the fourth division in the sub-scanning direction is the remaining 1,239 pixels).

Note that the second embodiment exemplifies calculation of each accumulated value at a size obtained by dividing one page into four in the sub-scanning direction. However, the 1-page division method and division count can also be freely set in the video count generation unit 302 via a setting bus (not shown) settable by a CPU 105. The division count may be changed in accordance with the size of an image to be printed.

After the end of calculating an accumulated value at the designated division size (¼ size of one page in the embodiment), the video count generation unit 302 compares an accumulated value counted, as needed, with a value set in advance in a count conversion LUT 303, and converts the counted accumulated value into a video count. In this fashion, a video count corresponding to each color component at an arbitrary division size of one page is obtained by looking up the count conversion LUT 303. A counter queue 307 receives the calculated video count at each division size and temporarily holds it.

Similar to the first embodiment, a halftone processing unit 304 performs halftone processing for multi-level image data counted by the video count generation unit 302, converting it into image data expressed by a binary value (1 bit). The binary image data processed by the halftone processing unit 304 is separated into the respective color components in image data via an inter-drum delay memory control unit 305. The separated color components are temporarily stored in a page buffer memory 306. Even in the second embodiment, the write and read operations in the page buffer memory 306 are executed at the same timings as those in FIG. 6.

A video count insertion unit 308 adds the video count of each divided area for each color component to a predetermined field for color component data sequentially output in response to VREQ_* (* indicates Y, M, C, and K).

[Data Format]

FIG. 8 is a view showing the data format of color component data and video count data added for each divided area in the second embodiment. Page data Y 801, page data M 802, page data C 803, and page data K 804 in FIG. 8 exemplify yellow, magenta, cyan, and black page data, respectively. Although the yellow page data Y 801 will be explained, the magenta page data M 802, cyan page data C 803, and black page data K 804 also have the same format.

Page ID 805 and Component ID 806 are an ID indicating the number of each page and an ID for identifying the color component of page data, as in FIG. 7 described in the first embodiment. Page Band Num 807 is a field indicating the division count of one page, and stores "4" indicating 4-division in the second embodiment. Note that the bit count of this field is defined in accordance with the dividable count.

Band Length0 808 to Band Length3 811 are fields each indicating the sub-scanning length of an area divided based on the division count indicated by the Page Band Num 807. In this arrangement, fields are defined in accordance with 4-division in the sub-scanning direction. That is, Band Length has four fields. When A4-size, 600-dpi image data of one page described above is divided into four in the sub-scanning direction, one page of A4 size is formed from 7,015 pixels in the main scanning direction×4,962 pixels in the sub-scanning direction. One page can be almost equally divided into four in the sub-scanning direction by setting values "1241", "1241", "1241", and "1239" in the four fields of Band Length0 808 to Band Length3 811. In the embodiment, values are stored in all Band Length0 to Band Length3 because of 4-division. However, when the division count is three or smaller, values are stored in only some of Band Length0 to Band Length2. When the maximum dividable count is larger, fields corresponding to this count are set.

Note that the embodiment defines fields capable of setting video counts for a plurality of divided areas of one page, like Count Y0 812 to Count Y3 815. In these fields, the video counts of the respective color components that are held in the counter queue 307 (to be described later) are added. Y-Plane Data0 816 to Y-Plane Data3 819 are also fields in which actual image data of the respective color components are stored in correspondence with the divided areas.

[Operations in Counter Queue and Video Count Insertion Unit]

Figure 16:
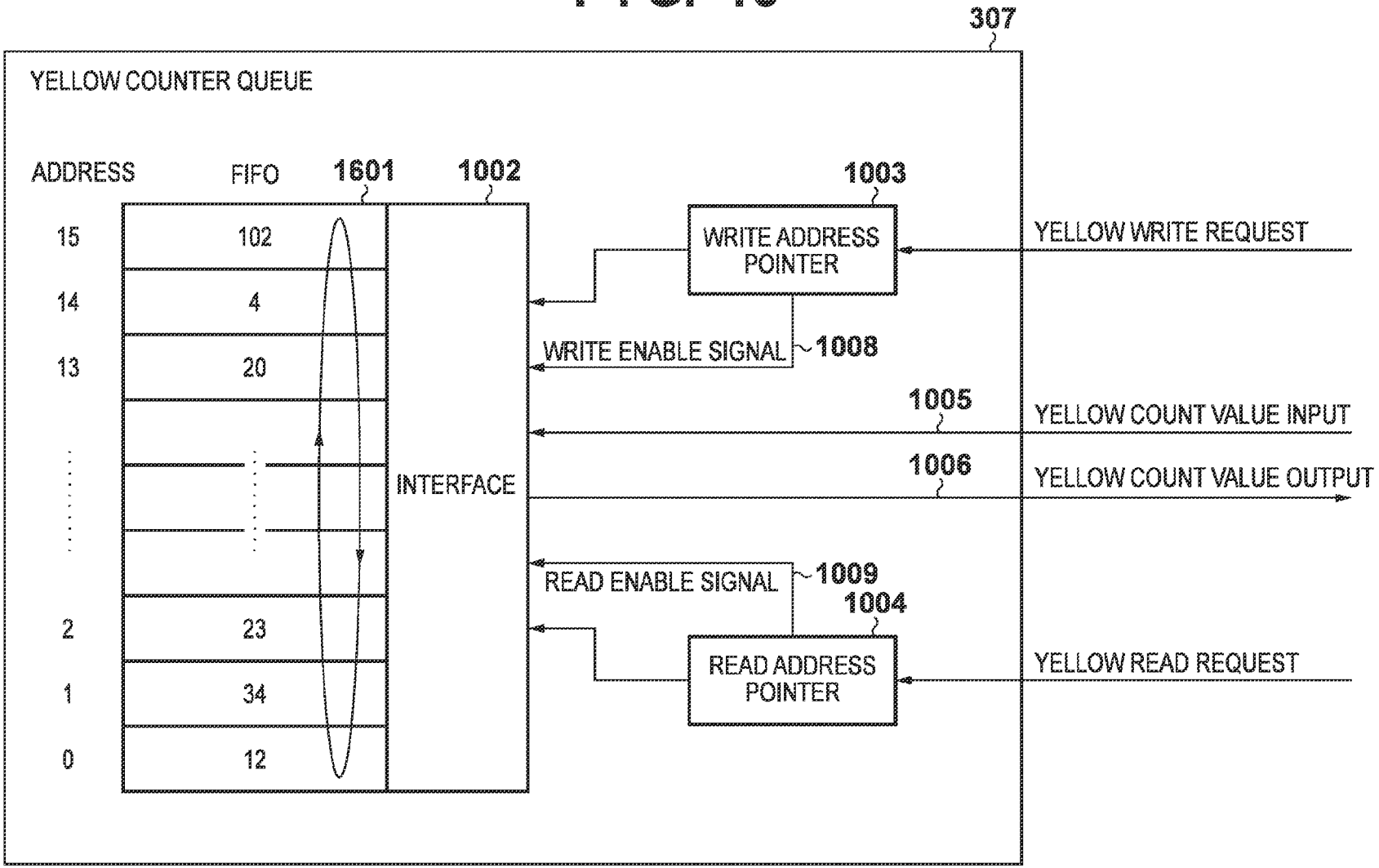
FIG. 16 is a view showing the internal arrangement of a counter queue according to the second embodiment.

The operations of the counter queue 307 and video count insertion unit 308 in the second embodiment will be explained. FIG. 16 is a view showing the internal arrangement of the counter queue 307 in the second embodiment. FIG. 16 shows the arrangement of a counter queue for yellow serving as one color component. The printer image processing unit 119 includes counter queues for the remaining magenta, cyan, and black color components, and these counter queues have the same arrangement. In the second embodiment, as shown in FIG. 16, the counter queue includes the memory of a 16-word long FIFO (First-In First-Out) 1601 as a counter queue. The remaining arrangement is the same as that in the first embodiment.

Similar to the timing chart of FIG. 11 described in the first embodiment, a write address pointer 1003 is incremented in synchronism with a write request signal, and a video count is stored in a predetermined address area of the FIFO 1601. In the second embodiment, one page is divided into four, and four video counts are calculated for each color in one page. Thus, the write request signal changes to "ON" four times for one page, and occupies four addresses for each color in one page. When the FIFO 1601 has addresses of a 16-word length and one page is divided into four, like the second embodiment, the FIFO 1601 can hold video counts for a total of four pages. In the second embodiment, one page is divided into four, and 16 addresses (four pages×four divisions) are held. However, the present invention is not limited to this, and the number of addresses may be changed in accordance with the division count.

The video count insertion unit 308 receives image data sequentially output from the inter-drum delay memory control unit 305 at a preceding stage. Upon receiving color component data based on a divided area set value set in advance by the CPU 105 via a bus (not shown), the video count insertion unit 308 sequentially transmits read request signals to the counter queue 307. In synchronism with the read request signal, a read address pointer 1004 is incremented. At the same time, a read enable signal 1009 changes to "ON". A video count value stored at an address based on a read address value is output to an interface 1002 and yellow count value output 1006. In the second embodiment, one page is divided into four, and four video counts are held for each color in one page. Thus, a read access signal changes to "ON" four times during processing of one page, and the video counts of the respective divided areas are output.

The video count insertion unit 308 adds count values corresponding to the respective color components. For the page data Y 801, the video count insertion unit 308 adds the Page ID 805, Component ID 806, Page Band Num 807, and Band Length0 808 to Band Length3 811 to the predetermined fields, and then inserts the Count Y0 812. After receiving Y-Plane Data0 serving as image data of the first divided area, the video count insertion unit 308 inserts the Count Y1 813. In this way, the video count insertion unit 308 inserts the video counts of the respective divided areas between image data, and transmits the resultant data as the page data Y 801 to a printer engine 102. Accordingly, the video count insertion unit 308 forms the page data * (* indicates Y, M, C, and K) 801 to 804 shown in FIG. 8. The page data M 802, page data C 803, and page data K 804 are also transmitted sequentially.

[Printer Engine Operation]

An operation when the printer engine 102 receives page header-added color component data output from the printer image processing unit 119 will be explained. The arrangement of the printer engine 102 is the same as those in FIGS. 12 and 14 described in the first embodiment, and a description thereof will not be repeated.

Figure 17:
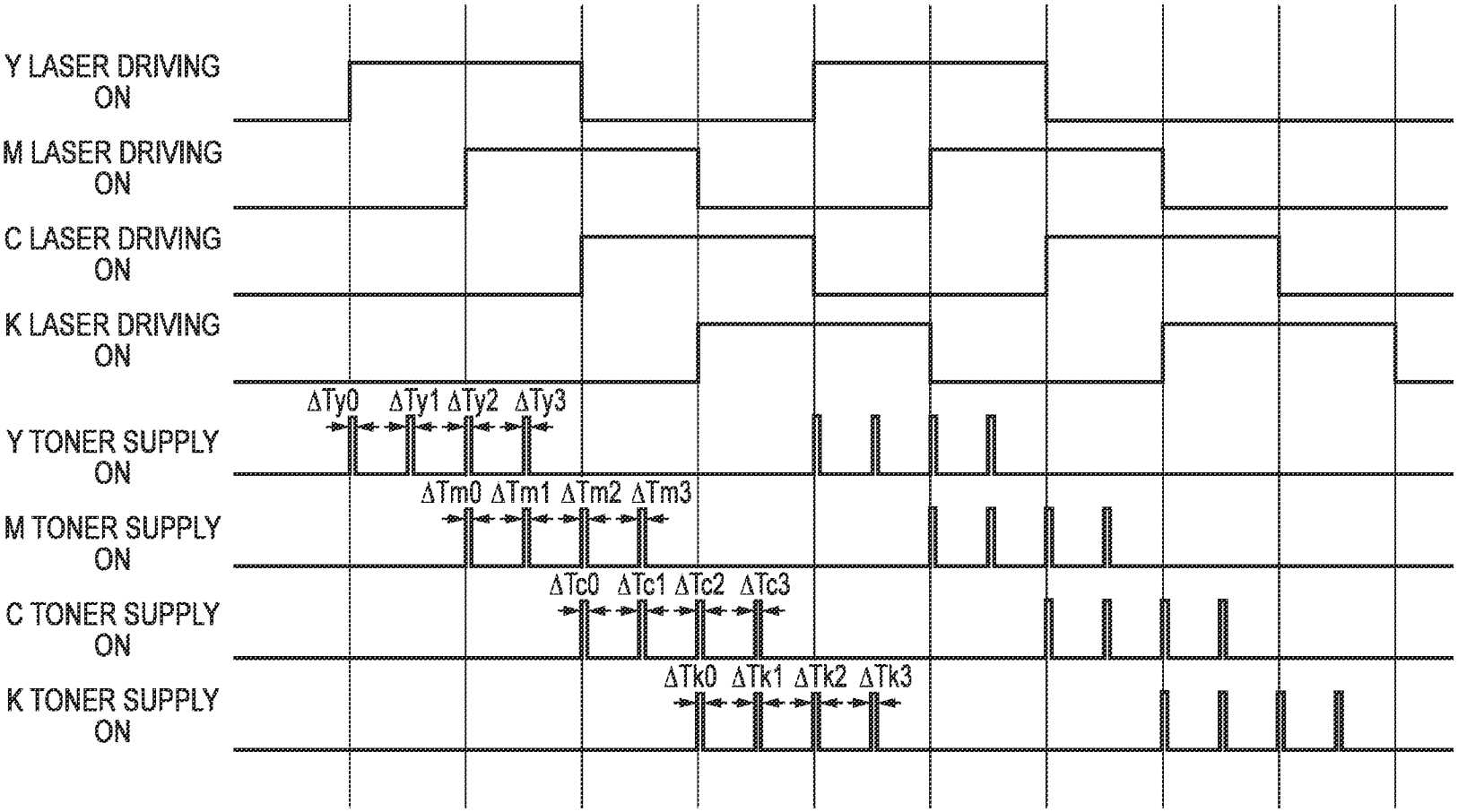
FIG. 17 is a timing chart showing laser driving and a toner supply operation according to the second embodiment.

FIG. 17 is a timing chart showing the laser driving timings of respective laser driving units based on the transmission timings of Y, M, C, and K color component data, and the driving timings of the toner supply motors of respective toner supply control units according to the second embodiment.

As shown in FIG. 17, the printer engine 102 receives *-Plane Data0 to *-Plane Data3 (* is one of Y, M, C, and K) serving as color component data of the respective divided areas for each color, and Count *0 to Count *3 (* is one of Y, M, C, and K) for supplying toner. The laser driving timings of the respective colors change to "ON" at timings of ΔTy0 to ΔTy3, ΔTm0 to ΔTm3, ΔTc0 to ΔTc3, and ΔTk0 to ΔTk3 during which toner is supplied at four divided timings of one page for each color. Hence, the laser driving timings of the respective colors and corresponding toner supply operations can always be synchronized with each other. Further, toner supply control is executed four times for one page, so the precision becomes higher than that in a case in which toner supply control is executed once for one page.

[Toner Supply Operation]

Figure 19A:
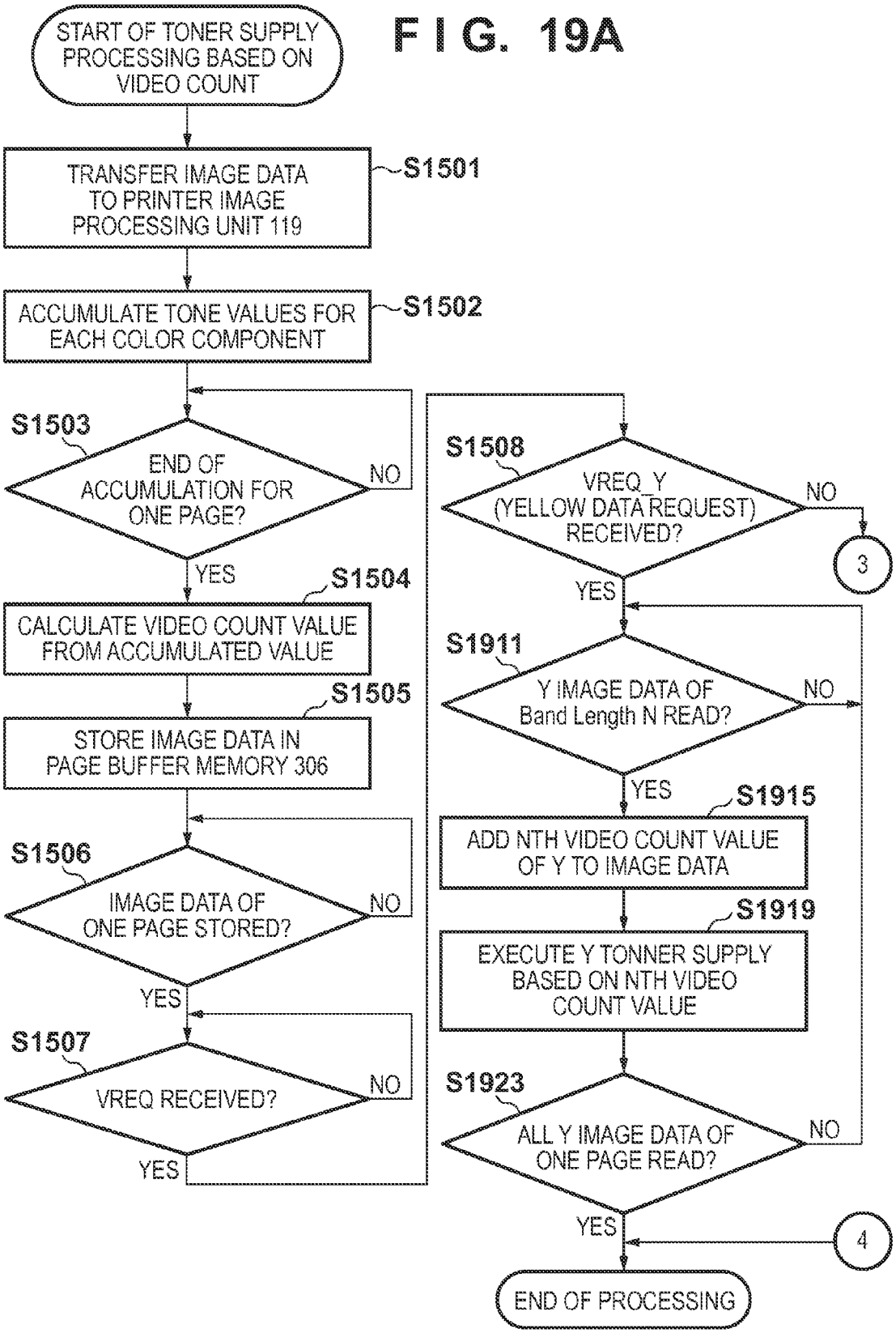
FIGS. 19A and 19B are flowcharts showing a toner supply operation according to the second embodiment.
Figure 19B:
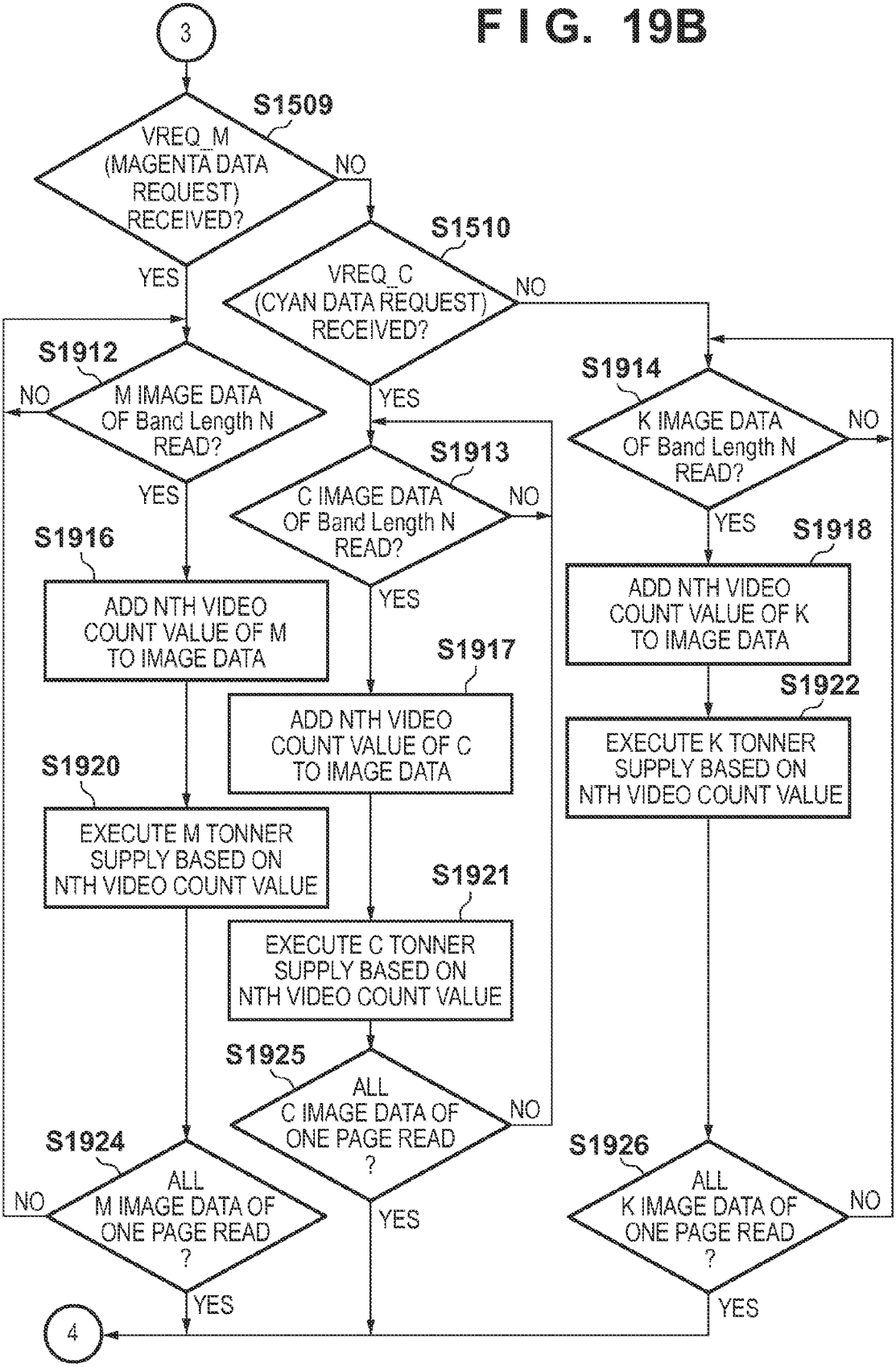

Generation of a video count, addition of image data, and a toner supply operation based on the video count according to the second embodiment will be described with reference to the flowcharts of FIGS. 19A and 19B. Note that this processing sequence is implemented by reading out a program stored in an HDD 108 serving as a storage unit or the like, and executing it by the CPU 105 of the image forming apparatus 100.

Steps S1501 to S1510 are the same as those in the first embodiment. After receiving VREQ_* of a corresponding color component, the inter-drum delay memory control unit 305 sequentially reads out corresponding color component data from the page buffer memory 306. As described above, the inter-drum delay memory control unit 305 sequentially acquires color component data of the Band Length0 808 to Band Length3 811 representing respective divided areas based on a division count designated in the Page Band Num 807. If the video count insertion unit 308 receives data of lines in the sub-scanning direction that are designated by Band Length0 (YES in step S1911, S1912, S1913, or S1914), it adds a corresponding video count (Count *0 812 in this case) to a predetermined field of the color component data (step S1915, S1916, S1917, or S1918).

Thereafter, a video count extraction unit 1202 in the printer engine 102 extracts the video count of each color component. * toner supply control units 1204 to 1207 execute toner supply of the respective colors based on the respective color component data in synchronism with laser exposure timings (steps S1919 to S1922). Processing from addition of video counts by the video count insertion unit 308 up to toner supply operations by the * toner supply control units 1204 to 1207 is repeated by a plurality of number of times for the respective colors in accordance with the division count designated in the Page Band Num 807. After reading out color component data of one page from the page buffer memory 306 (step S1923, S1924, S1925, or S1926), laser exposure by a laser driving unit 1212, 1213, 1214, or 1215 and development are done. The process then ends.

As described above, for example, one page is divided into a plurality of areas, and a video count is added to each divided area of the page. This arrangement can cope with the development timing difference between the respective color components in a tandem engine, and can execute toner supply control by a plurality of number of times for one page.

In addition to the effects of the first embodiment, the second embodiment can increase the toner supply precision. Also, the second embodiment can achieve printing at a stable density by executing toner supply control by a plurality of number of times for one page even in printing at a large size in the sub-scanning direction, like continuous paper.

Third Embodiment

In the first embodiment, information such as a video count is added to the header of the data format. The third embodiment will explain a method of adding a video count as a footer for each color component, and toner supply control based on this method.

An image forming apparatus 100 and each software module have the same arrangements as those in the first embodiment, a processing sequence up to input to a printer image processing unit 119 in a printer operation is also the same, and a description thereof will not be repeated.

Figure 4:
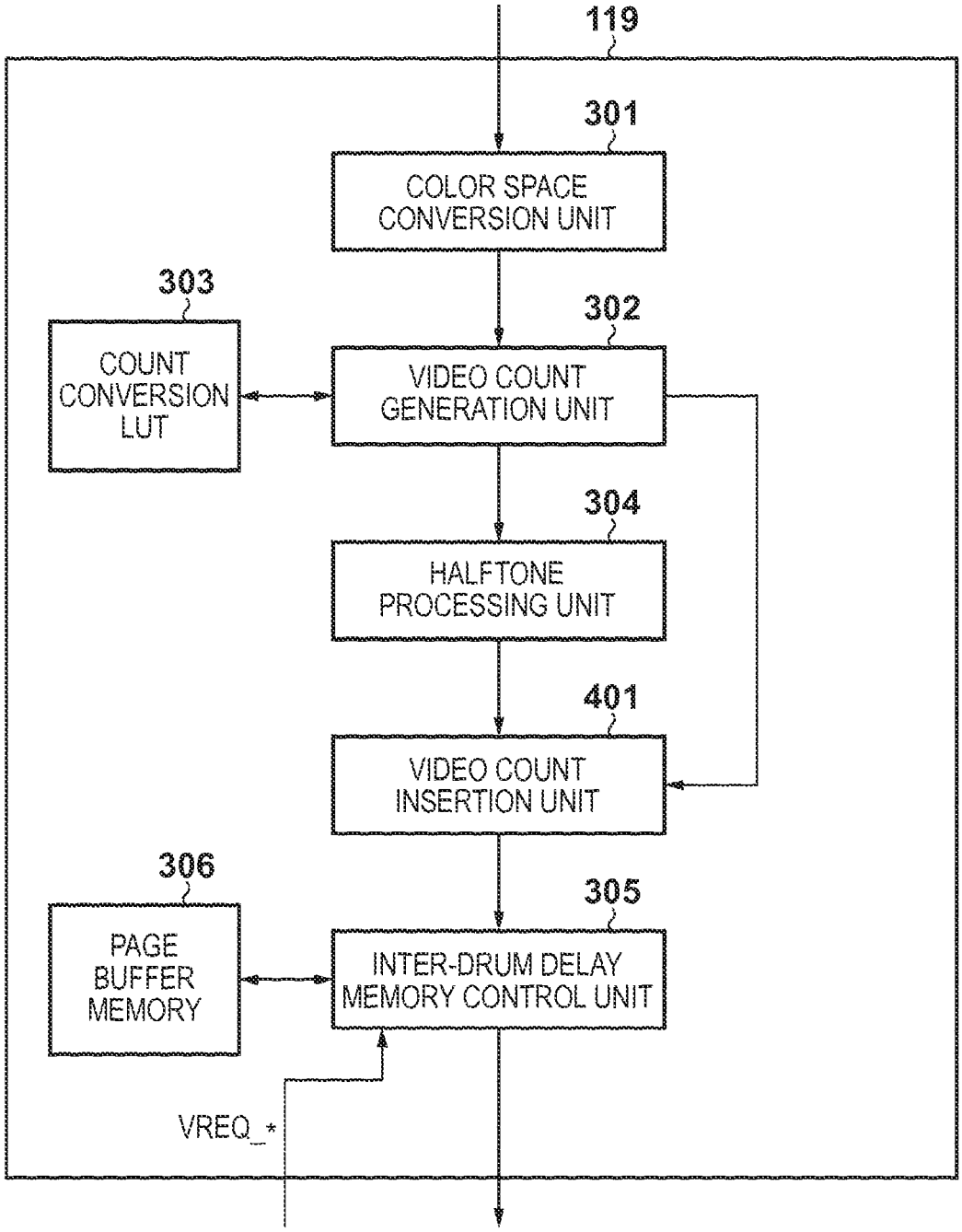
FIG. 4 is a block diagram showing the internal arrangement of a printer image processing unit according to the third embodiment.

FIG. 4 is a block diagram showing the internal arrangement of the printer image processing unit 119 in the third embodiment. In the third embodiment, a video count insertion unit 401 is arranged at the succeeding stage of a halftone processing unit 304. An inter-drum delay memory control unit 305 is arranged at the succeeding stage of the video count insertion unit 401. In the third embodiment, the printer image processing unit 119 does not include a counter queue 307, and a video count generation unit 302 directly inputs a video count to the video count insertion unit 401.

In the printer operation, similar to the first embodiment, a color space conversion unit 301 converts image data input to the printer image processing unit 119 from a luminance value (RGB in this embodiment) into a density value (CMYK in this embodiment) in the above-described manner. The video count generation unit 302 accumulates the tone values (multi-level data) of respective pixels for each color component in the image data converted into CMYK data. Similar to the first embodiment, tone values for one page are counted as an accumulated value.

The accumulated value obtained by the video count generation unit 302 is converted into the video count of one page for each color component using a count conversion LUT 303, and the video count is quickly transmitted to the video count insertion unit 401 at a succeeding stage. Similar to the first embodiment, the halftone processing unit 304 performs halftone processing for multi-level image data counted by the video count generation unit 302, converting it into image data expressed by a binary value (1 bit). In the third embodiment, the video count insertion unit 401 inserts the video count as the footer of image data in which each color component is expressed by a binary value (1 bit) by the halftone processing unit 304.

[Data Format]

Figure 9:
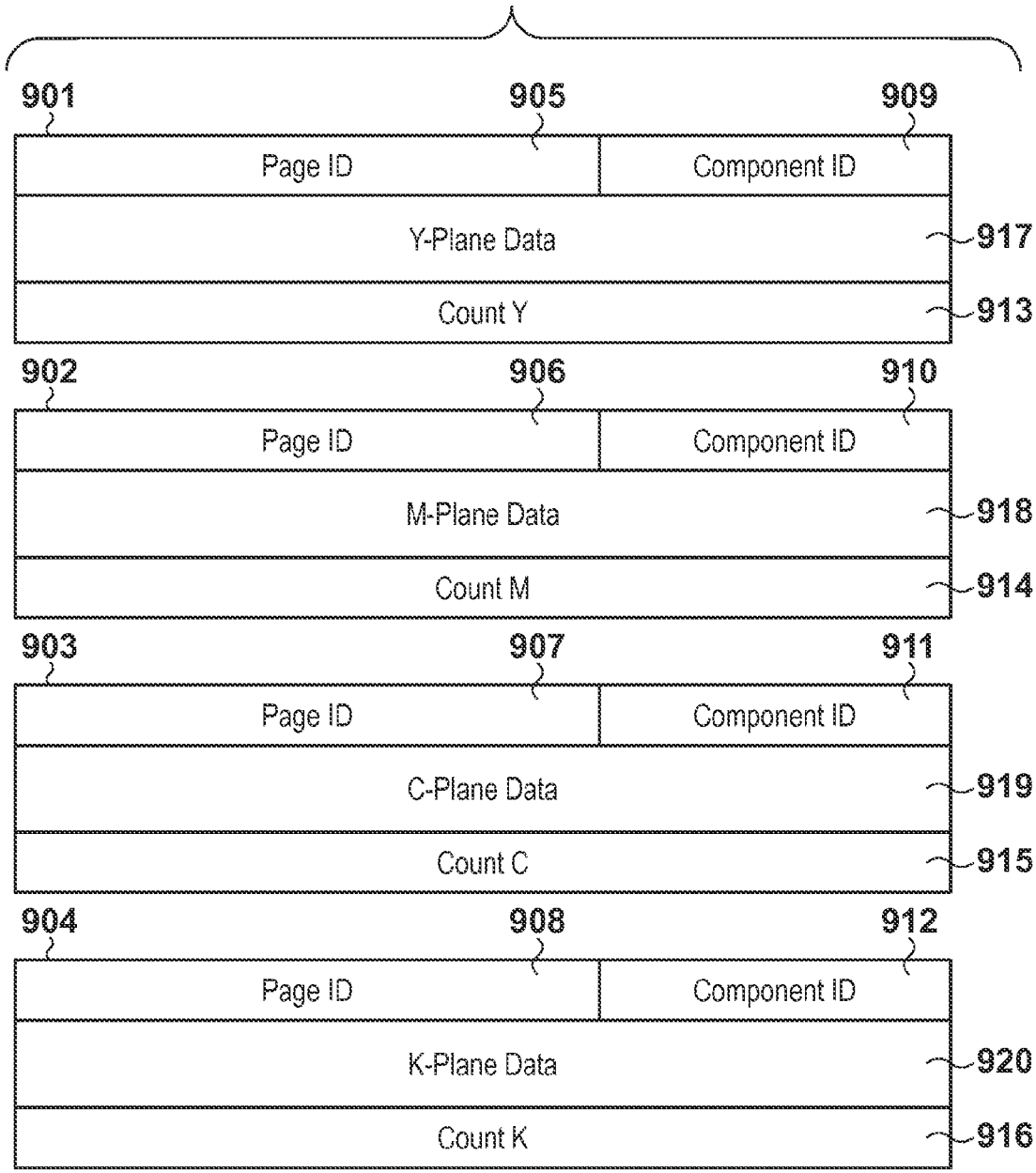
FIG. 9 is a view for explaining a data format according to the third embodiment.

FIG. 9 shows the data format of color component data and video count data added as a footer in the third embodiment. As shown in FIG. 9, Count * (* indicates Y, M, C, and K) 913 to 916 are added as footers after *-Plane Data 917 to 920 serving as respective color component data in the data format of the first embodiment.

[Toner Supply Operation]

Figure 18:
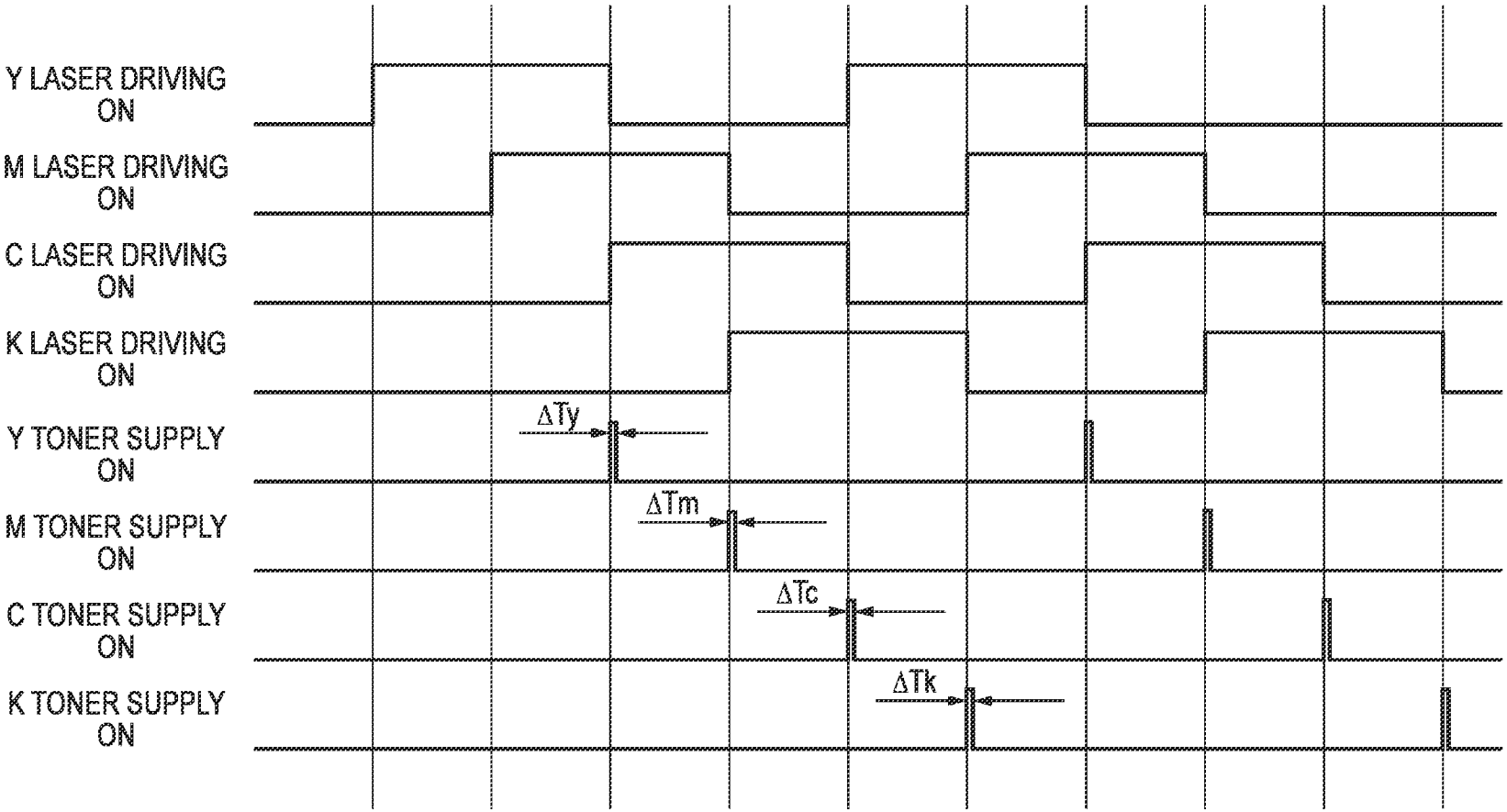
FIG. 18 is a timing chart showing laser driving and a toner supply operation according to the third embodiment.

FIG. 18 is a timing chart showing the laser driving timings of laser driving units 1212 to 1215 based on the transmission timings of the respective color component data, and the driving timings of toner supply motors 1208 to 1211 according to the third embodiment. As shown in FIG. 18, a page buffer memory 306 sequentially enables laser driving operations corresponding to Y, M, C, and K for the respective color components. Immediately after laser exposure, toner supply operations corresponding to the respective colors are executed. The toner supply control operations of the respective colors change to "ON" at the timings of ΔTy, ΔTm, ΔTc, and ΔTk shown in FIG. 18.

Figure 20A:
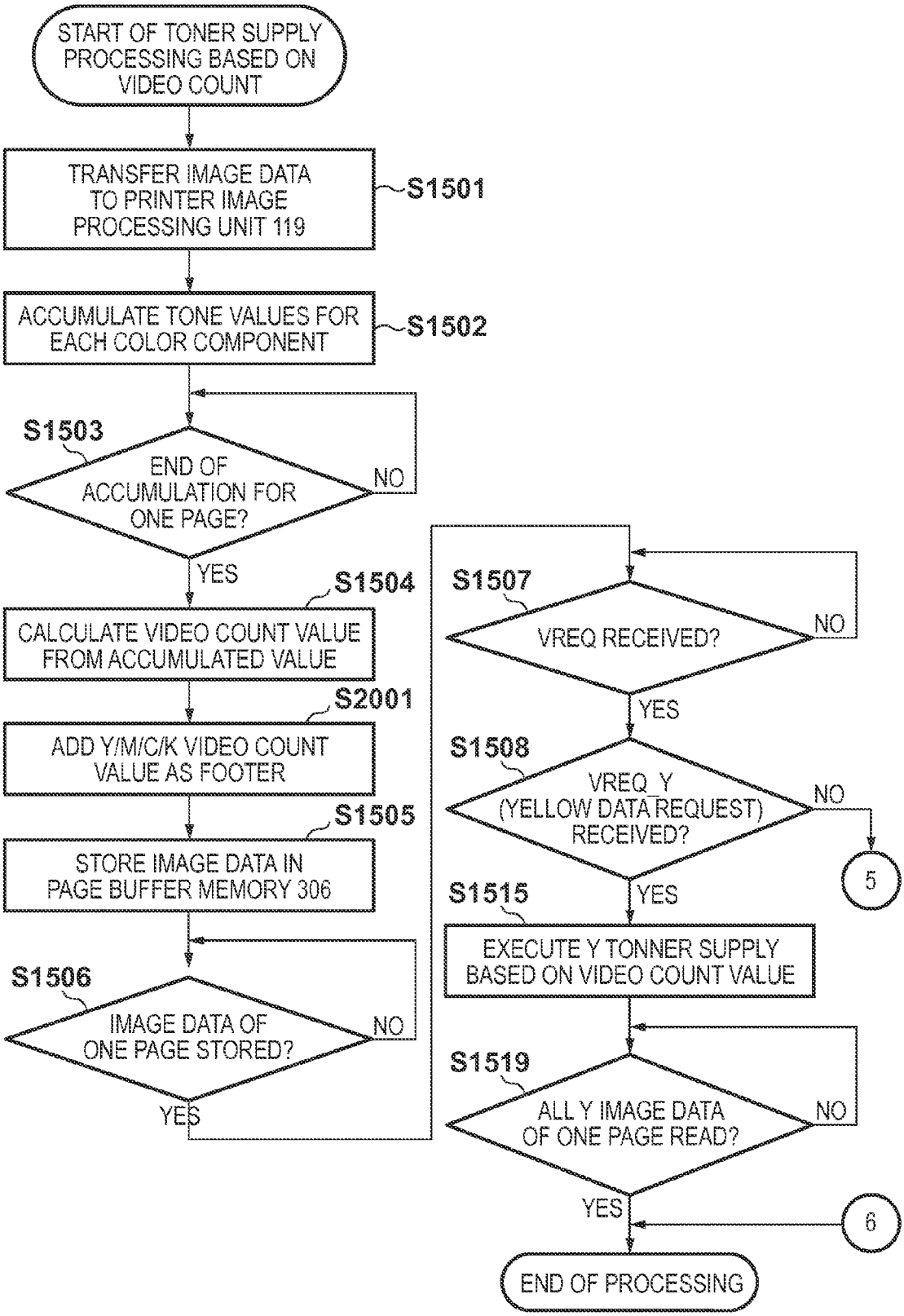
FIGS. 20A and 20B are flowcharts showing a toner supply operation according to the third embodiment.
Figure 20B:
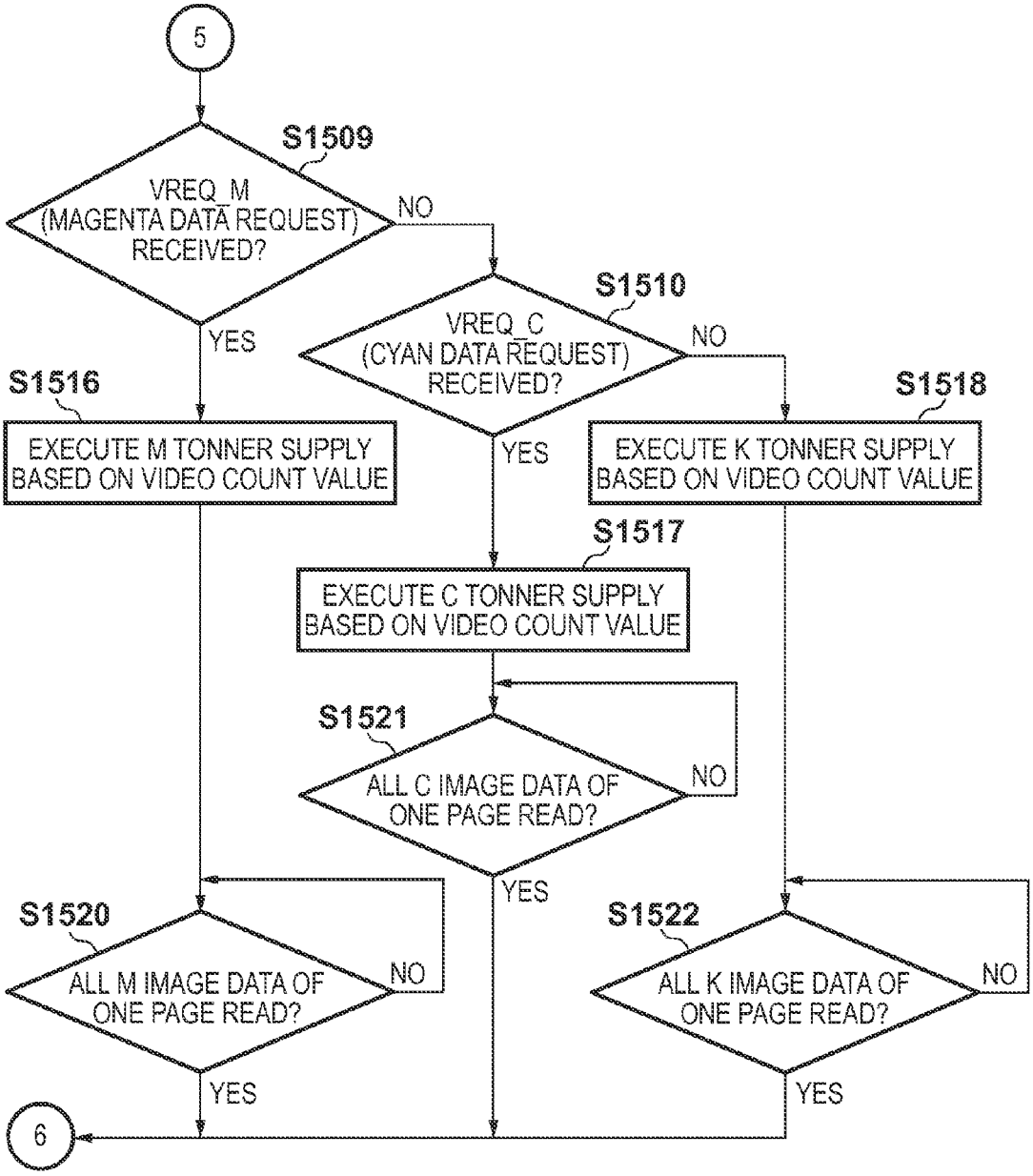

Generation of a video count, addition of image data, and a toner supply operation based on the video count according to the third embodiment will be described with reference to the flowcharts of FIGS. 20A and 20B. Note that this processing sequence is implemented by reading out a program stored in an HDD 108 serving as a storage unit or the like, and executing it by a CPU 105 of the image forming apparatus 100.

In steps S1501 to S1504, similar to the first embodiment, after the end of accumulation for one page, the video count generation unit 302 converts accumulated values into toner supply-related video counts by looking up a count conversion LUT 303. After the halftone processing unit 304 rasterizes image data into binary data of the respective color component data, the video counts calculated by the video count generation unit 302 are directly transmitted to the video count insertion unit 401. The video count insertion unit 401 simultaneously adds the video counts as the footers of the respective color component data in the fields of the Count * 913 to 916 (step S2001).

Similar to the first embodiment, the image data are sequentially stored in the page buffer memory 306. After storing image data of one page (YES in step S1506), the inter-drum delay memory control unit 305 waits until it receives VREQ_* (video data request signal) from a printer engine 102. After receiving VREQ_* (YES in step S1507), the inter-drum delay memory control unit 305 determines VREQ_* (* is one of Y, M, C, and K) of a corresponding color component (step S1508, S1509, or S1510). The inter-drum delay memory control unit 305 sequentially reads out corresponding color component data from the page buffer memory 306 in accordance with the received VREQ_* of each color component, and transmits them to the printer engine 102. A video count extraction unit 1202 in the printer engine 102 extracts the video count of each color component from the received data. Toner supply control units 1204 to 1207 execute toner supply of the respective colors based on the respective color component data in synchronism with laser exposure timings (steps S1515 to S1518). After reading out color component data of one page from the page buffer memory 306 (YES in one of steps S1519 to S1522), laser exposure by the laser driving unit 1212, 1213, 1214, or 1215 and development are done. The processing sequence then ends.

As described above, according to the third embodiment, the video count of each color is inserted as the footer of color component data of the color. In addition to the effects of the first embodiment, immediately after calculating a video count from image data, the video count can be inserted at an arbitrary timing. Therefore, the third embodiment does not require a counter queue which reads out a video count in synchronism with the output timing of image data from the page buffer memory. The circuit arrangement can be simplified.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-273943, filed Dec. 8, 2010, which is hereby incorporated by reference herein in its entirety.

What is claimed is:

1. An image forming apparatus including a developing device corresponding to a color component, comprising:

a conversion unit configured to accumulate, for each color component, values of respective pixels for each color component that fall within a predetermined range of image data, and to convert the accumulated value into a count value of the color component;

an addition unit configured to add, to the image data, the count value of each color component that has been converted by said conversion unit; and a control unit configured, when forming an image based on the image data, to supply toner to the developing device of each color component in accordance with the count value of the color component that has been added by said addition unit.

2. The apparatus according to claim 1, wherein said conversion unit accumulates the values of respective pixels for each color component in, as the predetermined range, a page unit or an area unit obtained by dividing a page into a plurality of areas.

3. The apparatus according to claim 1, wherein said addition unit adds the count value for the predetermined range in the image data.

4. The apparatus according to claim 1, wherein the image data is in a format that includes color component data having a header, and said addition unit adds the count value of each color component to the header of the color component data of the image data.

5. The apparatus according to claim 1, further comprising a holding unit configured to hold values of respective pixels for each color component in the image data, and the image data is in a format including a header, wherein said addition unit adds, as the header to a value for each color component in the image data sequentially output from said holding unit in synchronism with a timing to execute development by the developing device, the count value corresponding to the color component that has been acquired by said conversion unit.

6. The apparatus according to claim 4, further comprising a storage unit configured to store the count value converted by said conversion unit, wherein when adding the count value as the header to a value for each color component in the image data, said addition unit acquires the count value from said storage unit and adds the count value.

7. The apparatus according to claim 1, wherein the image data is in a format including a footer, and said addition unit adds, as the footer to values of respective pixels for each color component in the image data, the count value corresponding to the color component that has been acquired by said conversion unit.

8. The apparatus according to claim 1, wherein said conversion unit converts a value accumulated for each color component into the count value using a lookup table.

9. The apparatus according to claim 1, wherein the developing device forms a tandem engine including engines corresponding to color components of yellow, magenta, and cyan, yellow, magenta, cyan, and black, or yellow, magenta, cyan, black, light magenta, and light cyan.

10. A method of controlling an image forming apparatus including a developing device corresponding to a color component, comprising:

a conversion step of accumulating, for each color component, values of respective pixels for each color component that fall within a predetermined range of image data, and converting the accumulated value into a count value of the color component;

an addition step of adding, to the image data, the count value of each color component that has been converted in the conversion step; and a control step of, when forming an image based on the image data, supplying toner to the developing device of each color component in accordance with the count value of the color component that has been added in the addition step.

11. A non-transitory, computer-readable medium storing a program for causing a computer to function as:

a conversion unit configured to accumulate, for each color component, values of respective pixels for each color component that fall within a predetermined range of image data, and to convert the accumulated value into a count value of the color component, an addition unit configured to add, to the image data, the count value of each color component that has been converted by said conversion unit, and a control unit configured, when forming an image based on the image data, to supply toner to the developing device of each color component in accordance with the count value of the color component that has been added by said addition unit.

* * * * *